US006057803A

United States Patent [19]

Kane et al.

[11] Patent Number: 6,057,803

[45] **Date of Patent: *May 2, 2000**

[54] ANTENNA APPARATUS

[75] Inventors: Joji Kane, Nara; Takashi Yoshida, Ikoma; Akira Nohara, Nishinomiya; Noboru Nomura, Kyoto; Makoto Hasegawa, Tokyo; Naoki Adachi, Kawasaki, all of Japan

[73] Assignee: Matsushita Electric Industrial, Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,178

[22] Filed: Mar. 19, 1997

[30] Foreign Application Priority Data

Mar. 19, 1996 [JP] Japan ..... 8-062712

[51] Int. Cl.[7] ..... H01Q 1/32

[52] U.S. Cl. ..... 343/713; 343/867; 343/742

[58] Field of Search ..... 343/711, 712, 343/713, 715, 741, 742, 866, 867, 748, 743, 744, 745; H01Q 1/32

[56] References Cited

U.S. PATENT DOCUMENTS

| | | | |
|---|---|---|---|
| 2,520,988 | 9/1950 | Everitt | 343/713 |
| 4,801,944 | 1/1989 | Madnick et al. | 343/744 |
| 4,823,143 | 4/1989 | Ohe et al. | 343/713 |
| 4,873,530 | 10/1989 | Takeuchi et al. | 343/713 |
| 4,958,167 | 9/1990 | Schroeder | 343/713 |
| 5,177,493 | 1/1993 | Kawamura | 343/713 |
| 5,442,368 | 8/1995 | Harada et al. | 343/713 |
| 5,457,467 | 10/1995 | Schenkyr et al. | 343/713 |
| 5,572,226 | 11/1996 | Tuttle | 343/726 |

*Primary Examiner*—Hoanganh Le
*Attorney, Agent, or Firm*—Smith, Gambrell & Russell, LLP

[57] ABSTRACT

A plurality of antennas are disposed in a predetermined area and wherein size, configuration and mounting condition of the antennas are set so that their directivities formed by interference therebetween are most desirable.

5 Claims, 31 Drawing Sheets

SQUARE-LAW ANTENNA

DIPOLE

LOW-PROFILE ANTENNA

COMBINATION OF DIFFERENT TYPES

FEEDERS CLOSE TO EACH OTHER

FEEDERS IN THE SAME DIRECTION

FEEDERS AT AN ANGLE

FEEDERS AWAY FROM EACH OTHER

CONDUCTIVE MATERIAL CONNECTED

CONDUCTIVE MATERIAL
IN THE VICINITY

ANTENNA APPARATUS

BACKGROUND OF THE INVENTION

1. Field of the Invention

The present invention relates to a car-mounted antenna apparatus, for example, for AM broadcasting, FM broadcasting, TV broadcasting and radio telephones.

2. Related art of the Invention

In recent years, a car has been equipped with various kinds of radio devices such as a television set, a radio telephone and a navigation system as well as an AM/FM radio set and it is expected that this trend will continue as long as new types of radio apparatuses are devised with developments in information technology. Since there radio devices use different frequency bands and radio wave formats, it is necessary to provide a plurality of antennas therefor. As antennas, for example, rod antennas, V-type dipole antennas and loop antennas are used. Since it is necessary to provide an antenna for each of the radio apparatuses as mentioned above, the number of antennas mounted on a car increases as the number of radio devices mounted on the car increases. Conventionally, each of the antennas is designed to be suitable for its target radio wave so that it delivers the best performance for the frequency band it uses. With such antennas, the performance, such as the directional gain, degrades due to the influence of other antennas and members which are present in the vicinity. Consequently, it is necessary to dispose of a multiple number of antennas in a limited space such as a car in a manner such that as much distance as possible is kept therebetween in order to prevent interference with other members. Therefore, where and how to dispose the antennas is important.

However, in mounting antennas on a car, it is necessary to dispose the antennas so that a distance is kept therebetween as described above because conventional antennas are designed to be suitable for their target radio waves, so that a large space is necessary for mounting the antennas and it is cumbersome to decide where to dispose the antennas. In addition, the conventional antennas have disadvantages in easiness of handling and appearance such as feeder writing. That is, with the conventional antennas, a large space is necessary for disposing of a multiple number of antennas intensively or close to each other in a limited space such as a car because disposing of a multiple number of antennas intensively or close to each other degrades the performance of the antennas.

In addition, conventional antennas, which pick up radio waves from inside the car as well as radio waves from outside the car, face a problem that noises caused by the engine and the like become jamming waves to degrade the reception condition.

SUMMARY OF THE INVENTION

In view of the aforementioned problems of conventional antennas, an object of the prevent invention is to provide an antenna apparatus wherein a plurality of antennas are disposed intensively or close to each other in a small space, said antenna apparatus being capable of being reduced in size and preventing noises from inside the car.

The present invention according to one embodiment is an antenna apparatus wherein a plurality of antennas are disposed in a predetermined area and wherein the size, configuration and mounting conditions of the antennas are set so that their directivities formed by interference there between are most desirable.

According to this arrangement, a plurality of antennas may be disposed in a small area without any degradation of their directivity.

The present invention according to another embodiment is an antenna apparatus comprising two antennas and a synthesizer for synthesizing outputs of the two antennas, wherein said two antennas are disposed in a manner such that their antenna outputs have opposite phases for a radio wave coming from a predetermined direction.

According to this arrangement, the radio wave coming from the predetermined direction is canceled and by applying this principle, jamming waves and noises from specific directions are reduced.

The present invention according to yet another embodiment is an antenna apparatus wherein a dielectric material or a magnetic material or a metal material is disposed close to an antenna element.

According to this arrangement, the directivity of the antenna is improved with a simple arrangement.

The present invention according to still another embodiment is an antenna apparatus wherein a plurality of antennas are disposed close to each other each in a position where their directivity gain is law.

According to this arrangement, the influence of the interference with other antennas is reduced, so that the antennas may be disposed close to each other with their directivities maintained.

The present invention according to yet another embodiment is an antenna apparatus comprising a planar antenna element and at least one monopole antenna disposed close to said planar antenna element in a direction substantially vertical to a plane of said planar antenna element, wherein interference between said monopole antenna and said planar antenna element is used to receive vertically polarized waves.

According to this arrangement, vertically polarized waves may be received by a low-profile antenna.

The present invention according to another embodiment is an antenna apparatus comprising an antenna and impedance controlling means provided at a feeder of said antenna for controlling a directivity of said antenna.

According to this arrangement, the directivity of the antenna may be controlled.

The present invention according to yet another embodiment is a linear low-profile antenna wherein an antenna element is disposed at any of a rear spoiler, a trunk lid rear panel, a rear tray, a roof spoiler and a roof of a car.

The present invention according to still another embodiment is an antenna for vertically polarized waves wherein an antenna element is disposed at a portion inclined at least a predetermined angle to the horizontal.

The present invention according to another embodiment is an antenna for car-to-car communications wherein an antenna element is disposed in a body of a car.

The present invention according to yet another embodiment is an antenna for road-to-car communications wherein an antenna element is disposed in a body of a car.

By disposing the antennas as described above, the antennas may be mounted without any compromise on the appearance of the car.

The present invention according to still another embodiment is an antenna apparatus wherein a plurality of antennas are disposed in a predetermined area and wherein a part or all of said plurality of antennas are provided with means for changing impedance applied to said antennas or a switch for turning on and off the impedance applied to said antennas so that directivities of said antennas formed by interference between the antennas are most desirable.

According to this arrangement, the performance of the antenna is improved with a simple arrangement.

The present invention according to another embodiment is an antenna apparatus wherein a ground is disposed close to the antennas so that their directivities are more desirable.

According to this arrangement, desired directivities are obtained with a simple arrangement.

The present invention according to yet another embodiment is an antenna apparatus wherein one or two antenna elements wound a predetermined number of times are provided for a feeder.

According to this arrangement, a small-size and high-gain monopole or dipole antenna is realized.

The present invention according to still another embodiment is an antenna apparatus comprising n feeders connected to n antennas, less than n feeders, and a coupled circuit for connecting said less than n feeders and said n feeders.

According to this arrangement, the number of cables is reduced, so that the total weight of the cables is reduced.

The present invention according to another embodiment is an antenna apparatus wherein a switch for selecting an antenna providing optimum wave propagation from among said plurality of antennas to switch to the selected antenna is disposed between a feeder and a radio apparatus.

According to this arrangement, more excellent reception condition is obtained.

BRIEF DESCRIPTION OF THE DRAWINGS

FIG. 11(*b*) shows the frequency characteristic of the antenna apparatus.

DESCRIPTION OF THE REFERENCE DESIGNATIONS

Figure 1A:
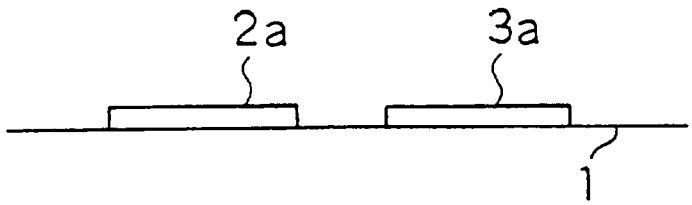
FIGS. 1(*a*)–1(*d*) schematically show examples of an antenna apparatus according to a first embodiment of the present invention.
Figure 1B:
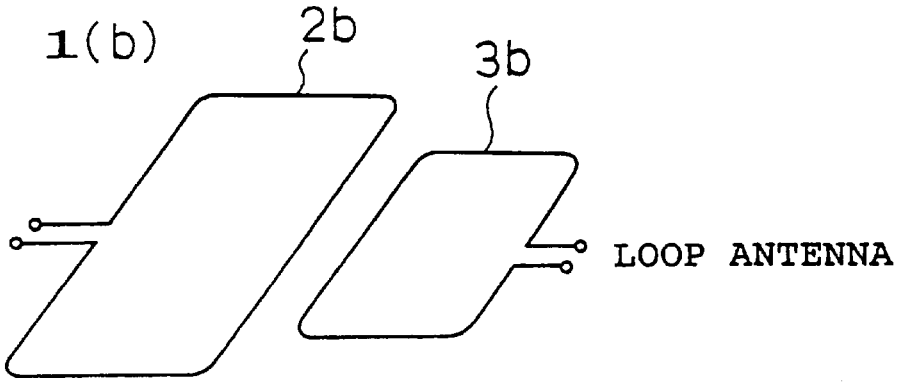
Figure 1C:
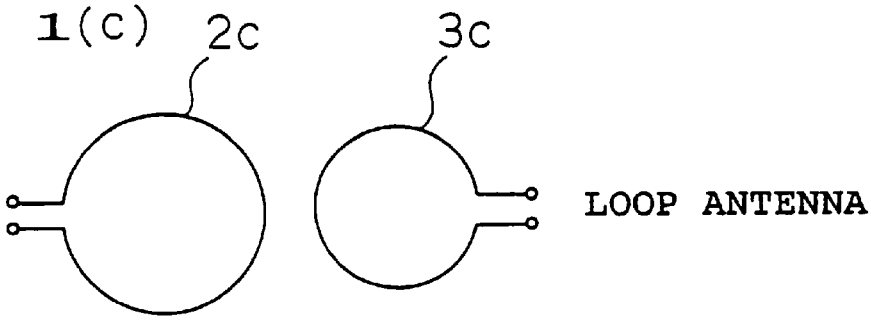
Figure 1D:
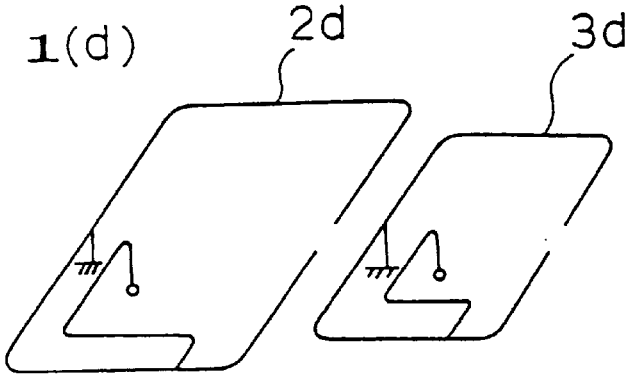

1 Reference plane
2*b,* 3*b,* 2*c,* 3*c* Loop antenna
2*d,* 3*d,* 11*c* Square-law antenna
11*a,* 12*a,* 12*c* Dipole antenna
11*b,* 12*b* Low-profile antenna
32 V-type dipole antenna
33*a* Heiro antenna
35 Inverted L-type antenna
36 Inverted F-type antenna
37 M-type antenna
41 Patch antenna
42 Microstrip antenna
57, 58, 59 Feeders
97 Multilayer printed circuit board
111, 123 Synthesizer
126, 132, 142 Dielectric material
152 Conductive material
192 Monopole antenna
204 Varicap
231 Ground
258 Band-pass filter
273 Diversity change-over switch

Preferred Embodiments of the Invention

Hereinafter, the present invention will be described with reference to the drawings showing embodiments thereof.

First Embodiment

First, the principle of this embodiment will be described. As mentioned in the description of the prior art, conventional antennas are each designed so that their directivity is suitable for their target radio wave, so that disposing a plurality of antennas close to each other degrades the directivities of the antennas because of the interference between the antennas. In the present invention, positively using this phenomenon, a plurality of antennas are disposed intensively or close to each other and the size, configuration and mounting conditions of the antennas are decided so that their directivities become most desirable for their target radio waves by being influenced by the interference between the antennas. With this arrangement, only a small space is necessary for mounting a plurality of antennas, so that a multiple number of antennas are easily disposed in a limited space such as a car.

FIGS. 1(*a*)–1(*d*) schematically show examples of an antenna apparatus according to a first embodiment of the present invention. FIG. 1(*a*) laterally shows two antennas 2*a* and 3*a* disposed close to each other in a plane (referred to as the reference plane) substantially the same as the antenna plane. FIG. 1(*b*) shows two square loop antennas 2*b* and 3*b* disposed close to each other. FIG. 1(*c*) shows circular loop antennas 2*c* and 3*c* disposed close to each other. FIG. 1(*d*) shows square-law antennas 2*d* and 3*d* disposed close to each other.

Figure 2A:
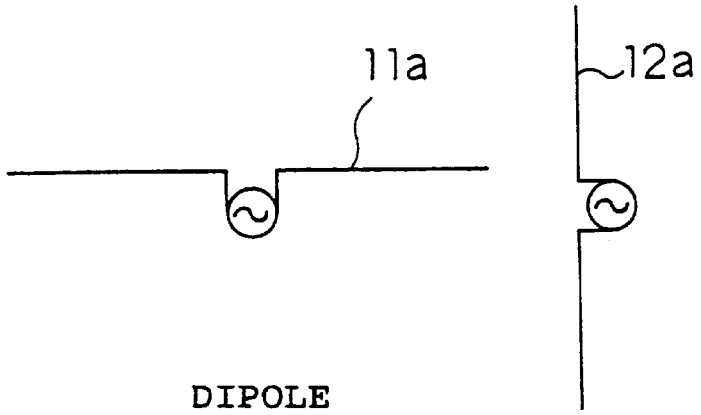
FIGS. 2(*a*)–2(*c*) schematically show other examples of the antenna apparatus according to the first embodiment.
Figure 2B:
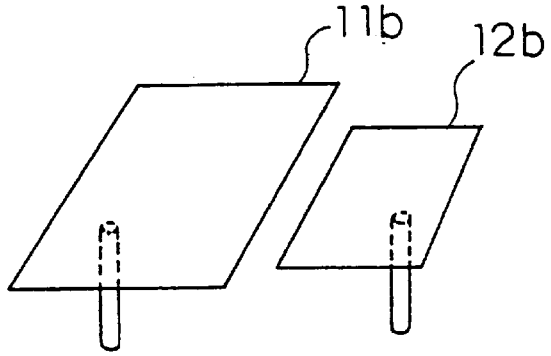
Figure 2C:
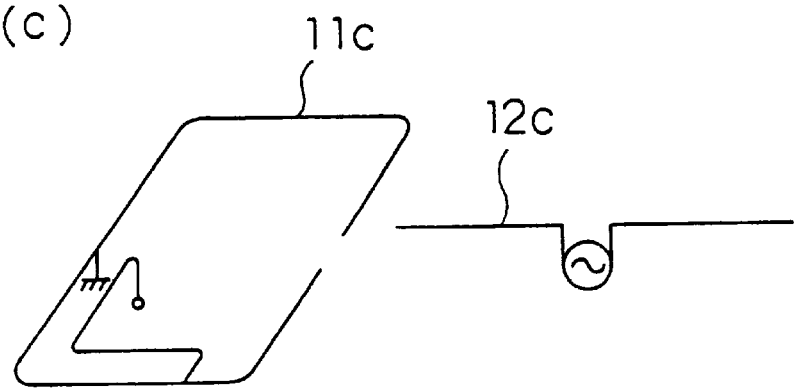
Figure 3A:
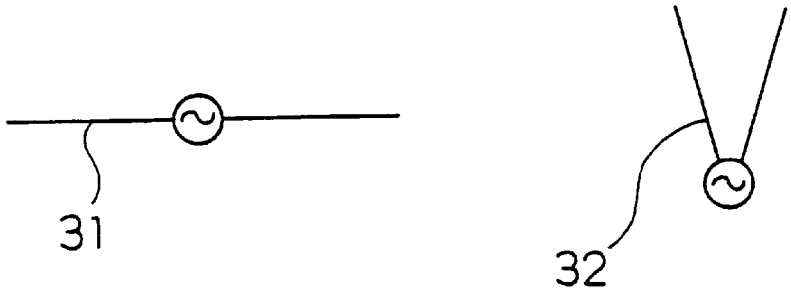
FIG. 3 schematically shows examples of types of antennas used in the present invention.
Figure 3B:
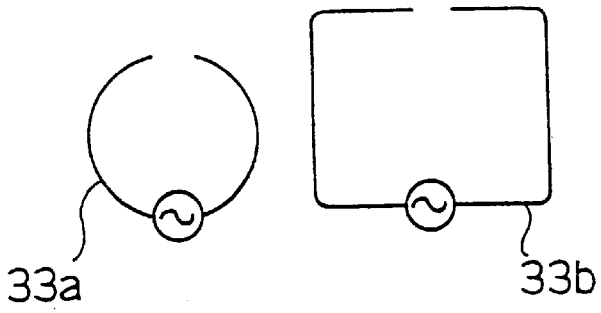
Figure 3C:
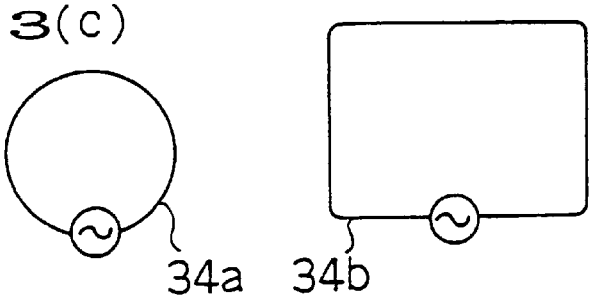
Figure 3D:
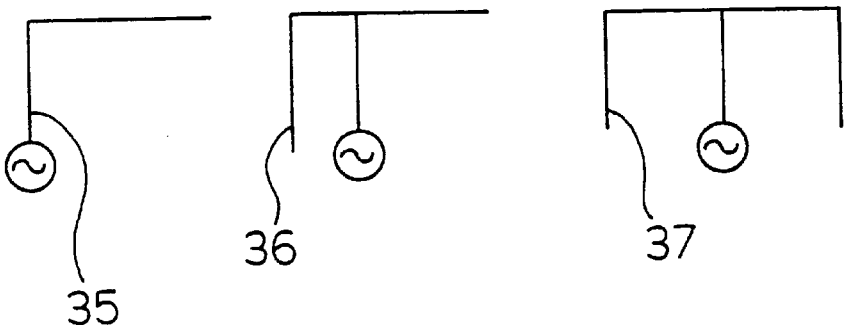

FIG. 2(*a*) shows dipole antennas 11*a* and 12*a* disposed close to each other. FIG. 2(*b*) shows low-profile antennas 11*b* and 12*b* disposed close to each other. FIG. 2(*c*) shows two antennas of different types, i.e., a square-law antenna 11*c* and a dipole antenna 12*c* disposed close to each other. In the present embodiment, other types of antennas may be used instead of the above-mentioned types of antennas. While the distance between the antennas disposed close to each other is not specifically limited, it is more advantageous and desirable if the distance is ¼ the wavelength or shorter.

The number of antennas disposed close to each other is not limited to two but may be three or more. When antennas for AM broadcasting, FM broadcasting, TV broadcasting and radio telephones are disposed close to each other, for example, they may be disposed intensively in one place.

Figure 4A:
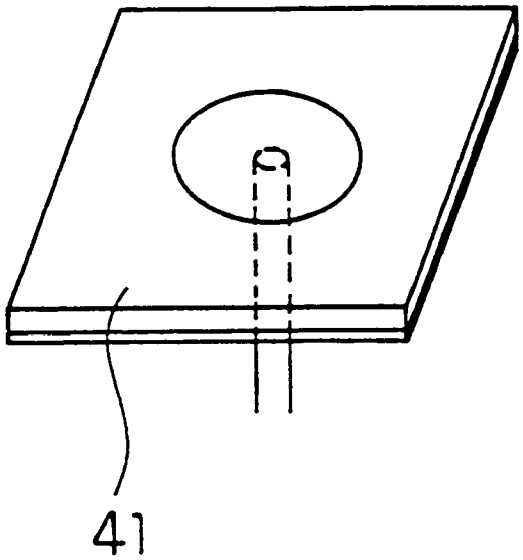
FIG. 4 schematically shows other examples of types of antennas used in the present invention.
Figure 4B:
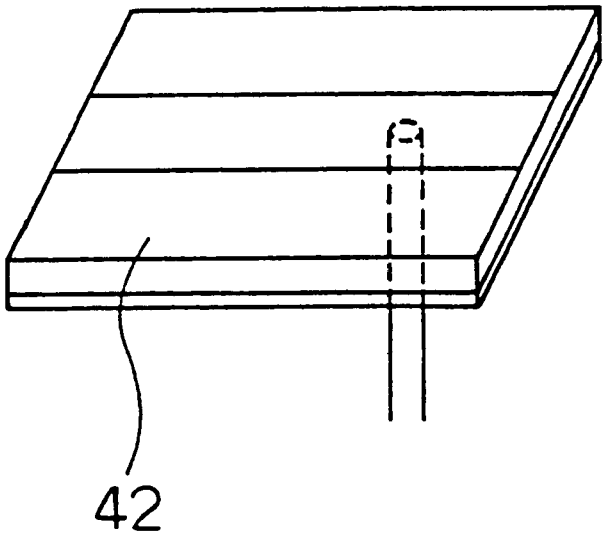

FIG. 3 schematically shows examples of antennas applicable to the present invention. These antennas are also applicable to subsequently-described embodiments of the present invention. As shown in FIG. 3, the antennas adopted in the present embodiment are as follows: as linear antennas, a dipole antenna 31 and a V-type dipole antenna 32; and as bent antennas, a heiro antenna 33*a,* a square-law antenna 33*b,* a circular loop antenna 34*a,* a square loop antenna 34*b,* an inverted L-type antenna 35, an inverted F-type antenna 36 and an M-type antenna 37. The low-profile antenna (see FIG. 2(*b*)), a patch antenna 41 and a microstrip antenna 42 as shown in FIG. 4 may also be adopted.

Figure 5A:
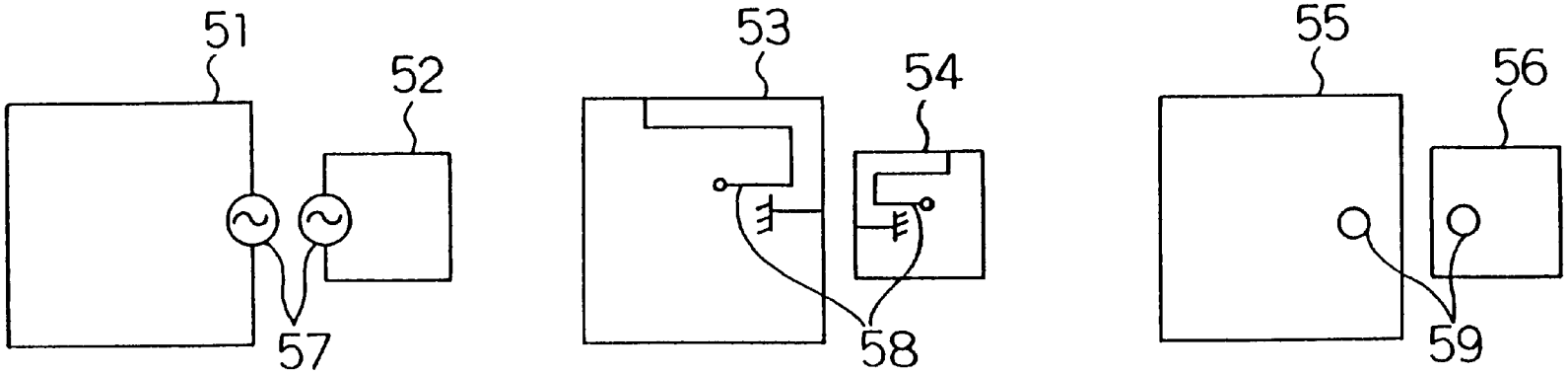
FIGS. 5(*a*) and 5(*b*) schematically show examples of positional relationships between antennas in the first embodiment.
Figure 5B:
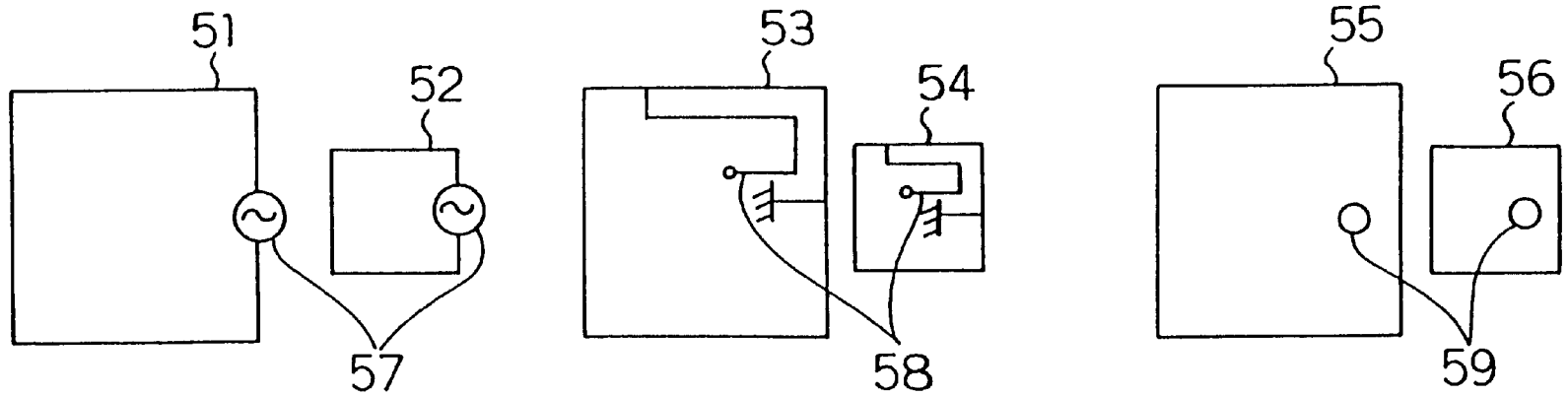

The positional relationship between the feeders of the antennas, which may be any given relationship, includes ones as shown in FIG. 5. As shown in FIG. 5(*a*), feeders 57, 58 and 59 may closely face each other, or as shown in FIG. 5(*b*), the feeders 57, 58 and 59 may face in the same direction.

Figure 6A:
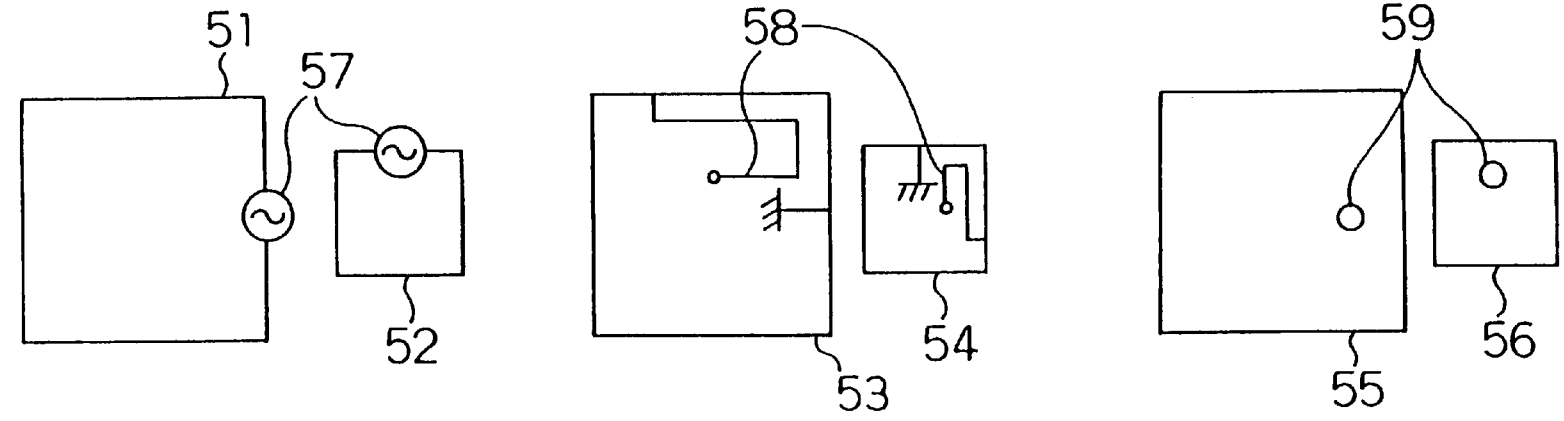
FIGS. 6(*a*) and 6(*b*) schematically show other examples of positional relationships between antennas in the first embodiment.
Figure 6B:
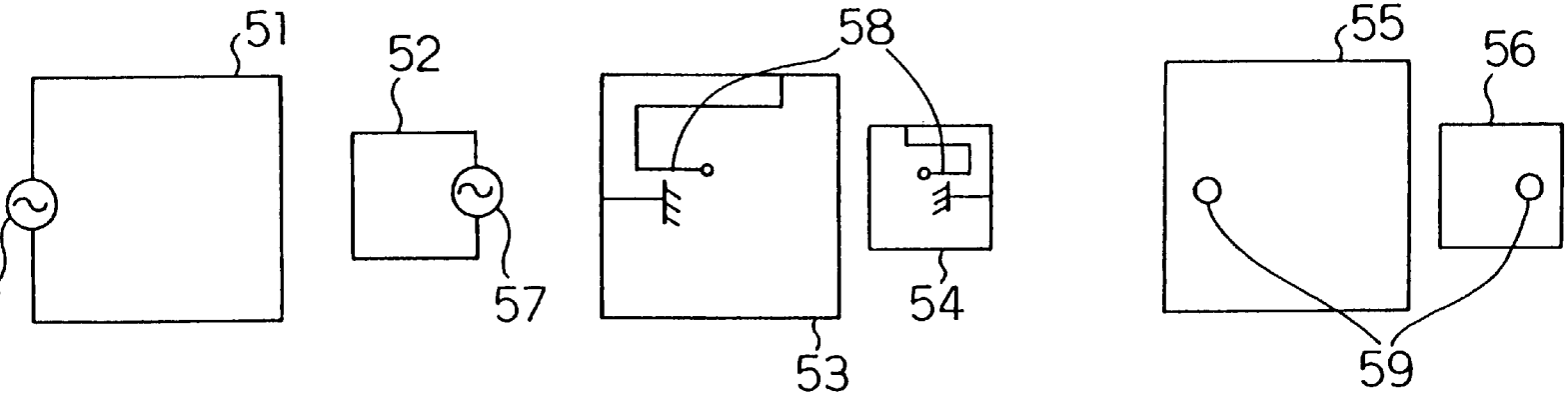
Figure 7A:
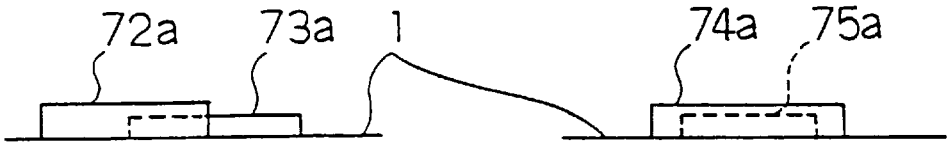
FIGS. 7(*a*)–7(d) schematically show examples of an antenna apparatus according to a second embodiment of the present invention.
Figure 7B:
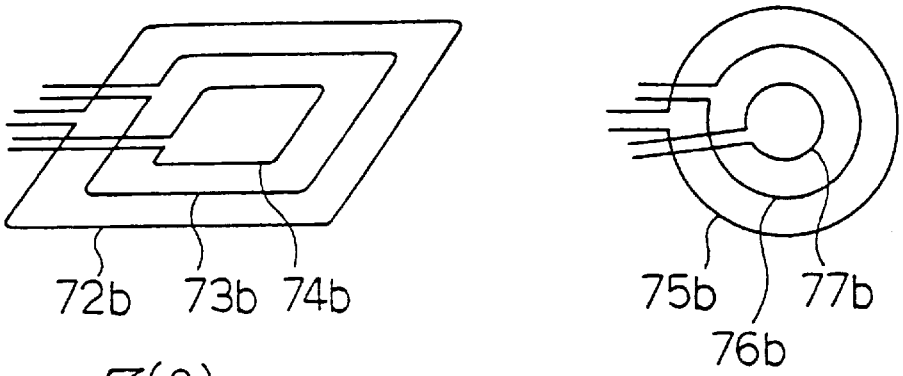
Figure 7C:
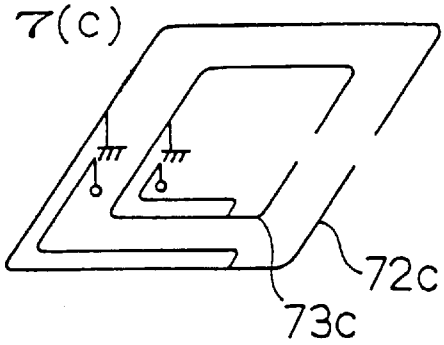
Figure 7D:
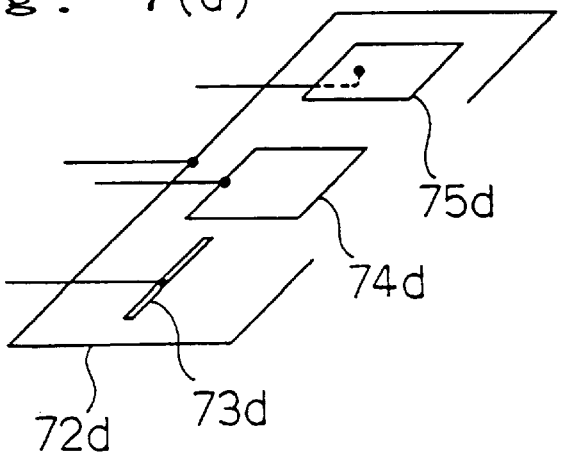

Further, as shown in FIG. 6(*a*), the positional relationship between the feeders 57, 58 and 59 may be such that one of the antennas is turned 90 degrees (the angle is not necessarily 90 degrees but may be a predetermined angle) in the antenna plane, or as shown in FIG. 6(*b*), the feeders 57, 58 and 59 may face away from each other. FIGS. 5(*a*) to 6(*b*) show from the left the case of loop antennas 51 and 52, the case of square-law antennas 53 and 54 and the case of low-profile antennas 55 and 56.

In fabricating the antenna according to the present embodiment, the antenna element may be formed by using printed writing on a circuit board as well as by processing a metal member. The use of printed wiring facilitates the fabrication of the antenna, so that cost reduction, size reduction and reliability improvement are expected.

Second Embodiment

FIG. 7(*a*) to 7(*d*) schematically show examples of an antenna apparatus according to a second embodiment of the present invention. This embodiment is different from the first embodiment in that, as shown in FIG. 7(*a*), a plurality of antennas 72*a* and 73*a* or 74*a* and 75*a* are intensively disposed so that one is nested in another in reference plane 1 including the antennas. In the case of the loop antennas, for example, as shown in FIG. 7(*b*), a medium-size loop antenna 73*b* (76*b*) is disposed within a larger loop antenna 72*b* (75*b*) and a smaller loop antenna 74*b* (77*b*) is disposed within the medium-size loop antenna 73*b* (76*b*). FIG. 7(*c*) shows an example using two square-law antennas 72*c* and 73*c* of different sizes. FIG. 7(*d*) shows an example using antennas of different types. A dipole antenna 73*d,* a loop antenna 74*d* and a low-profile antenna 75*d* are disposed within a larger square-law antenna 72*d*. FIGS. 7(*b*) to 7(*d*) show examples of arrangements of FIG. 7(*a*) where the smaller antenna is wholly nested in the larger antenna. The smaller antenna may be partly nested like the left arrangement of FIG. 7(*a*).

Figure 8A:
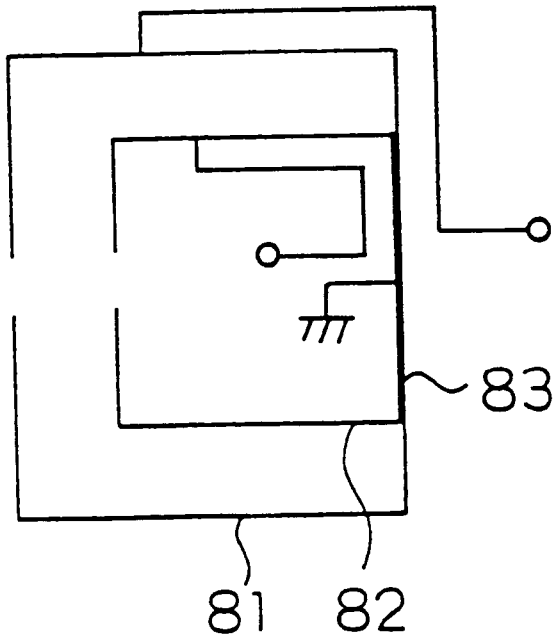
FIGS. 8(*a*) and 8(*b*) schematically show modifications of the second embodiment.
Figure 8B:
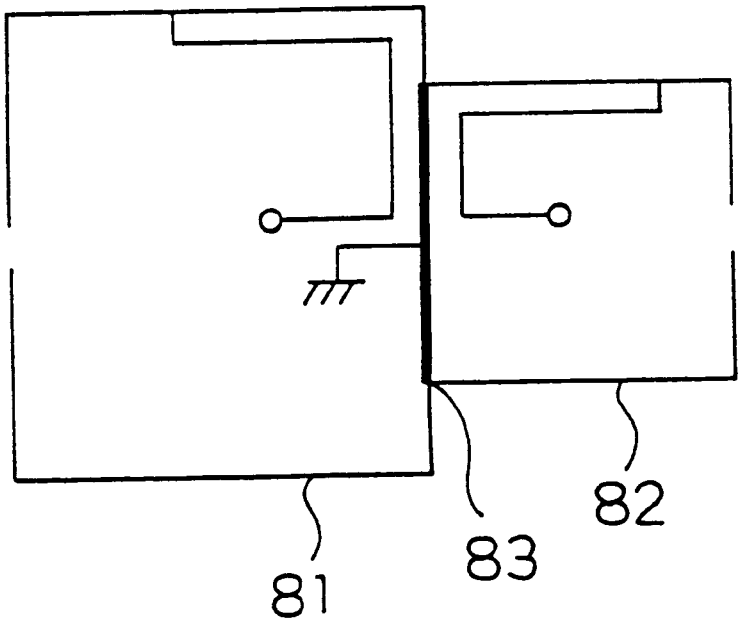

As modifications of the present embodiment, as shown in FIGS. 8(*a*) and 8(*b*), the antenna element may be partly shared by a plurality of antennas. FIG. 8(*a*) shows an example where a smaller square-law antenna 82 is disposed in a larger square-law antenna 81 sharing an antenna element 83 therewith. FIG. 8(*b*) shows an example where the smaller square-law antenna 82 is disposed in contact with the larger square-law antenna 81 through the shared antenna element 83.

Third Embodiment

Figure 9A:
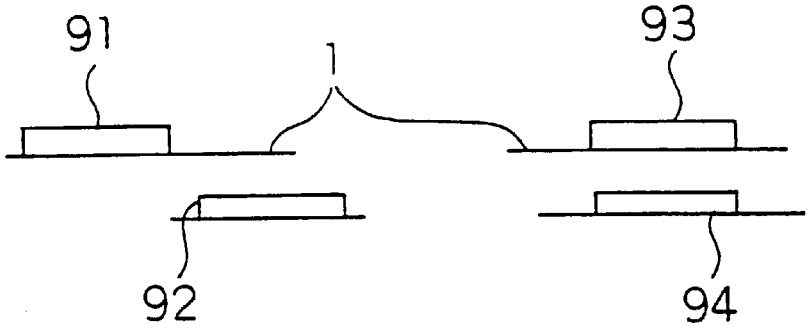
FIGS. 9(*a*) and 9(*b*) schematically show examples an antenna apparatus according to a third embodiment of the present invention.
Figure 9B:
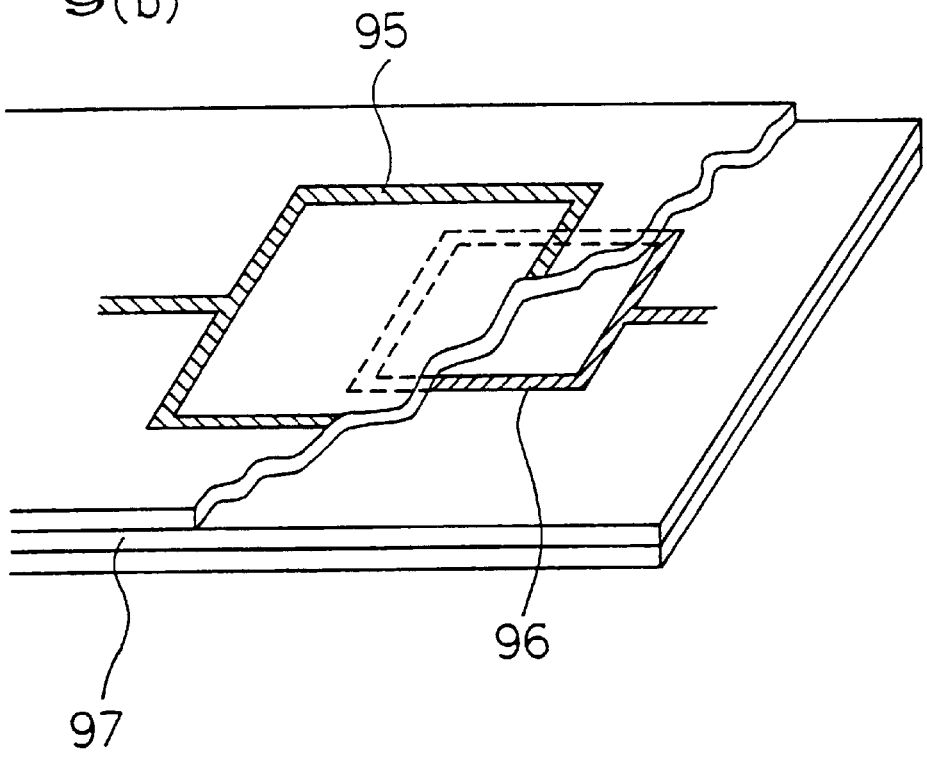

FIG. 9 schematically shows examples of an antenna apparatus according to a third embodiment of the present invention. This embodiment is different from the above-described first and second embodiments in that, as shown in FIG. 9(*a*), two antennas 91 and 92 or 93 and 94 are disposed in a layer in a direction vertical to the reference plane 1. In this arrangement, the antennas may be disposed not to overlap each other as shown in the left view or may be disposed so that one is wholly or partly superposed over another as shown in the right view. FIG. 9(*b*) which shows an application of the present embodiment, is a partially cutaway view of loop antennas 95 and 96 formed on a multilayer printed circuit board 97 by using printed wiring. In this example, the antennas are disposed to overlap each other.

Fourth Embodiment

Figure 10A:
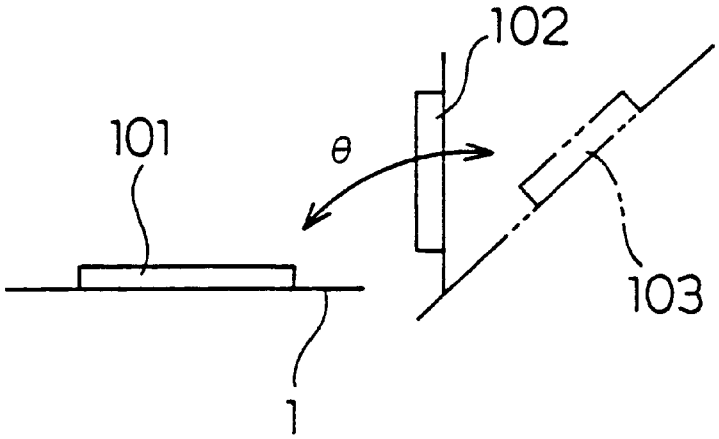
FIGS. 10(*a*) and 10(*b*) schematically show examples of an antenna apparatus according to a fourth embodiment of the present invention.
Figure 10B:
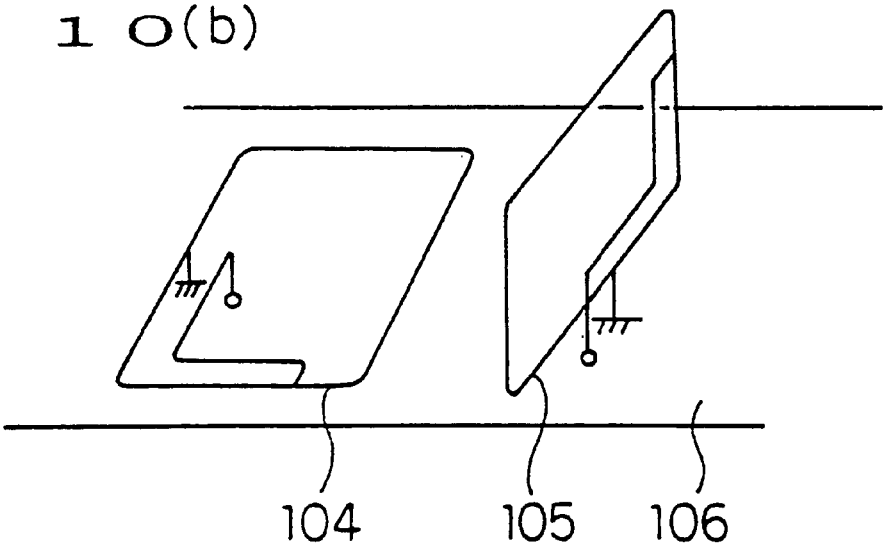

FIGS. 10(*a*) and 10(*b*) schematically show examples of an antenna apparatus according to a fourth embodiment of the present invention. This embodiment is different from the above-described embodiments in that, as shown in FIG. 10(*a*), two antennas 101 and 102 are stereoscopically disposed so that their antenna planes form a predetermined angle Θ (in this case, 90 degrees). By adjusting the predetermined angle Θ (e.g. antenna 103), the directivity is controlled. FIG. 10(*b*) shows an example where square-law antennas 104 and 105 are disposed on a plate 106 to be perpendicular to each other.

Fifth Embodiment

Figure 11B:
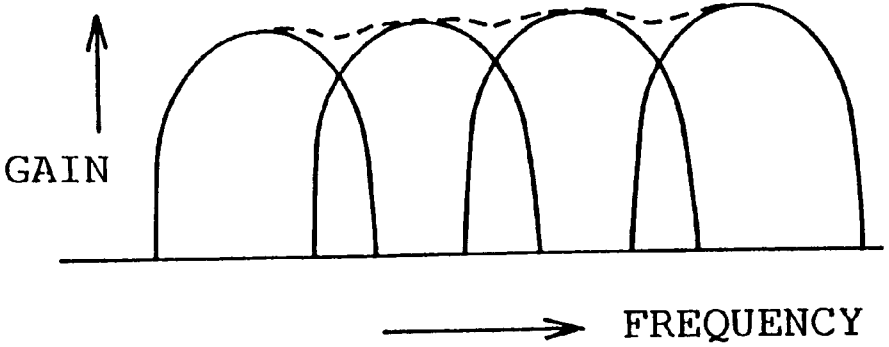
FIG. 11(*a*) schematically shows an antenna apparatus according to a fifth embodiment of the present invention.
Figure 11A:
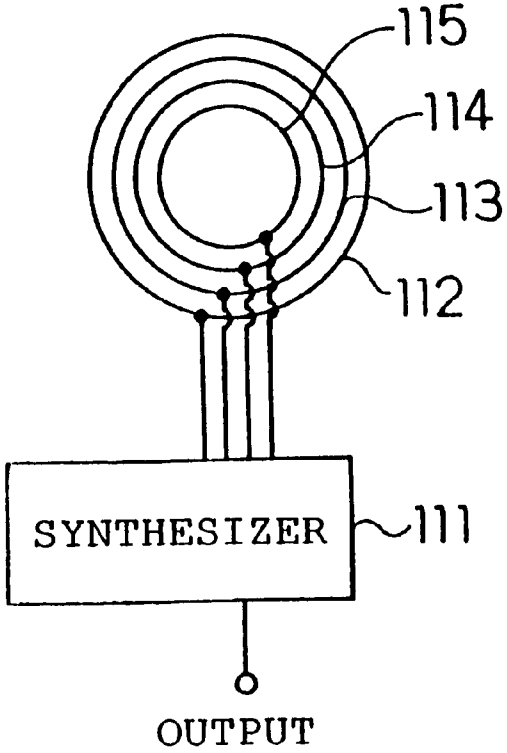

In this embodiment, the target frequency band is divided and a plurality of antennas, each corresponding to a divisional band, are intensively disposed in any of the manners described in the above embodiments to synthesize their antenna outputs by a synthesizer. As shown in FIG. 11(*a*), for example, the antenna outputs of loop antennas 112, 113, 114 and 115 are coupled to a synthesizer 111. With this arrangement, the directivity gains of the antennas improve and the target frequency band increases as shown in FIG. 11(*b*) in a limited mounting area.

Sixth Embodiment

Figure 12A:
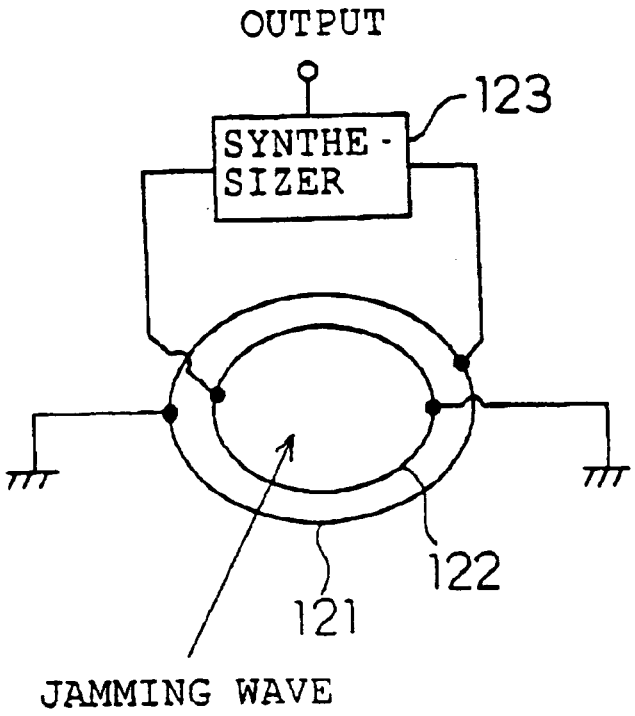
FIGS. 12(*a*) and 12(*b*) schematically show examples of an antenna apparatus according to a sixth embodiment of the present invention.
Figure 12B:
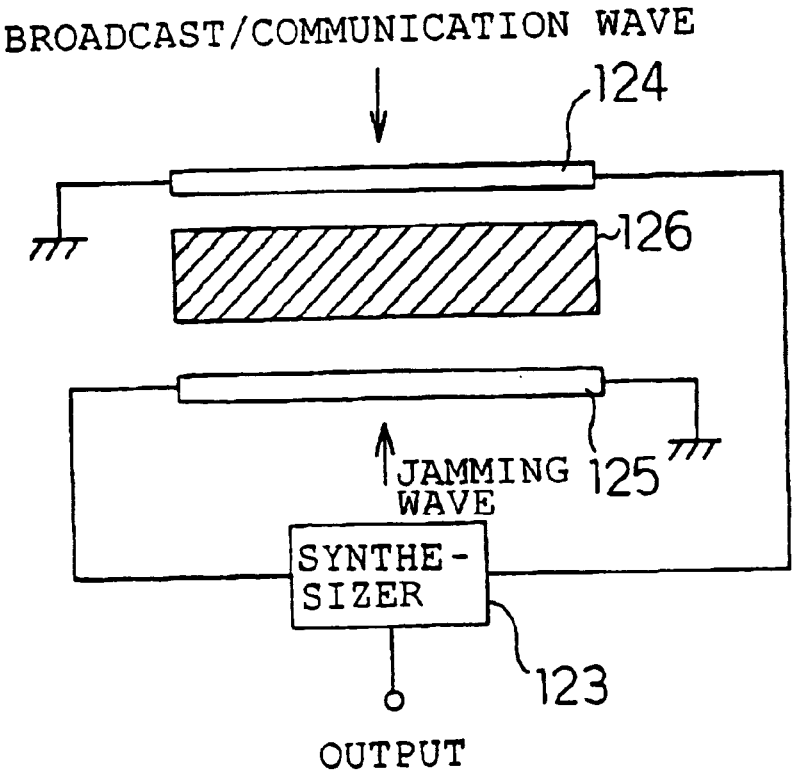

FIGS. 12(*a*) and 12(*b*) schematically show examples of an antenna apparatus according to a sixth embodiment of the present invention. The basic arrangement of the antennas according to this embodiment is that, as shown in FIG. 12(*a*), two antennas 121 and 122 are intensively disposed in a manner such that the two antenna outputs have opposite phases for a radio wave coming from a predetermined direction. By synthesizing the two antenna outputs by a synthesizer 123, the radio wave coming from the predetermined direction is canceled.

FIG. 12(*b*) shows an application of the above-described principle. In this example, two antennas 124 and 125 are lined up in a direction from which radio waves are coming and a dielectric material 126 is inserted between the two antennas 124 and 125. The reason for the insertion of the dielectric material 126 is as follows: Since the antennas 124 and 125 are disposed so that one functions as a director and the other functions as reflector according to the principle of a Yagi antenna, it is necessary that the distance between the two antennas 124 and 125 be ¼ the wavelength. If the distance is ¼ the wavelength, however, the actual distance is too long to be practical. The dielectric material 126 is inserted to reduce the actual distance. The outputs of the two antennas 124 and 125 are taken out after being synthesized by the synthesizer 123. With this arrangement, by disposing the antenna 124 functioning as a director outside the car body and disposing the antenna 125 functioning as a reflector inside the car body, for example, signals are taken out where waves such as broadcast waves and communication waves coming from outside the car are emphasized. In addition, noises from inside the car caused by the engine and the like are canceled, so that unnecessary noises are reduced and desired signals are obtained. A phase shifter may be inserted between one of the antenna outputs and the synthesizer so that the phase may be adjusted.

Seventh Embodiment

Figure 13A:
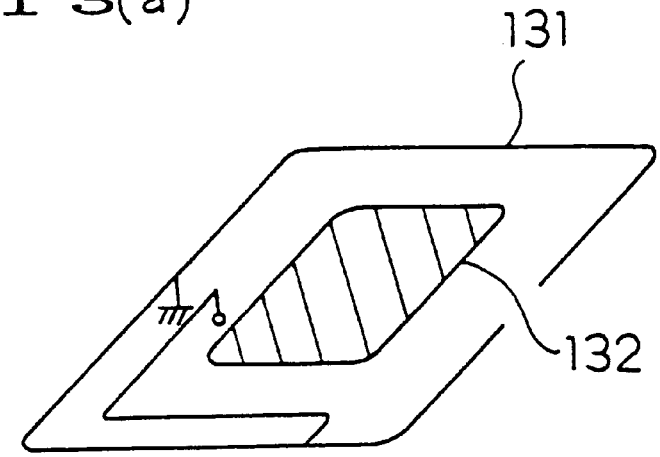
FIGS. 13(*a*)–13(*c*) schematically show examples of an antenna apparatus according to a seventh embodiment of the present invention.
Figure 13B:
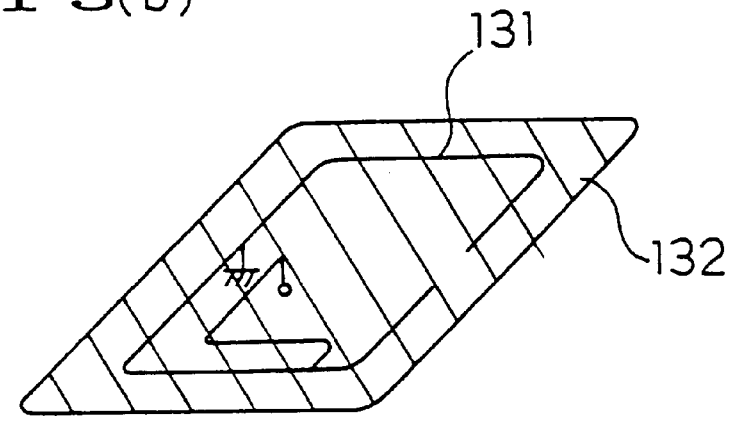
Figure 13C:
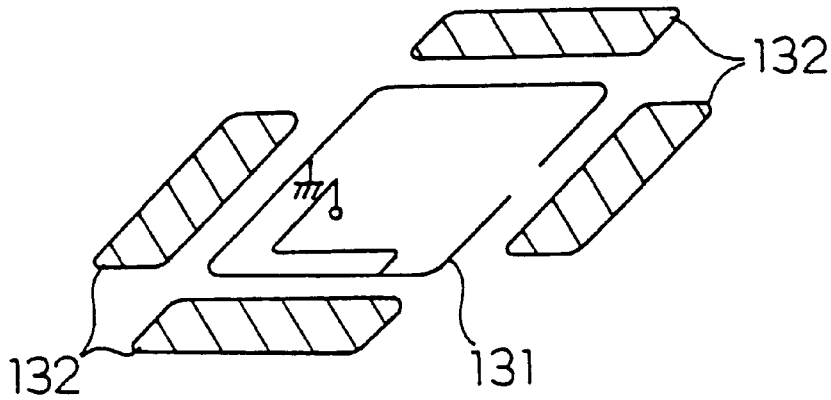
Figure 14A:
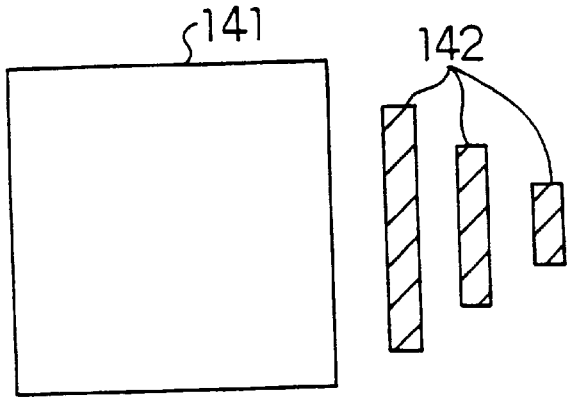
FIGS. 14(*a*)–14(*d*) schematically show other examples of the antenna apparatus according to a seventh embodiment.
Figure 14B:
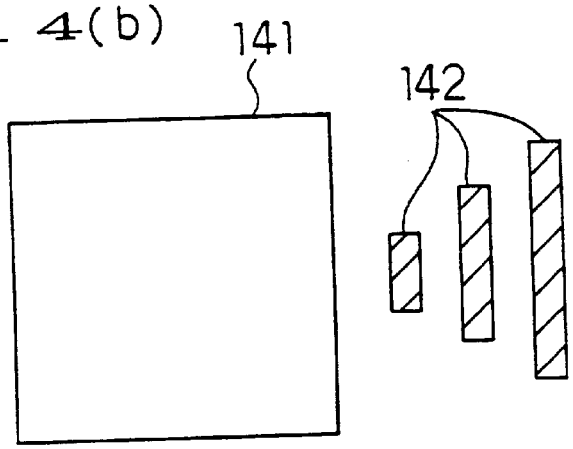
Figure 14C:
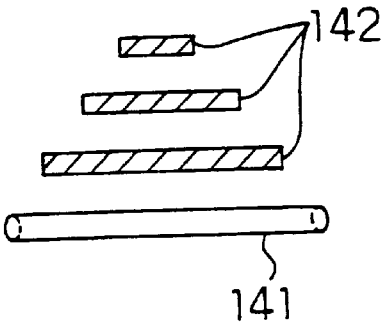
Figure 14D:
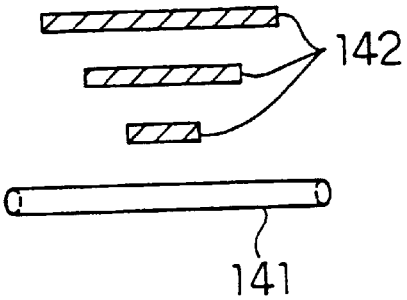

FIGS. 13(*a*) to 13(*c*) schematically show examples of an antenna apparatus according to a seventh embodiment of the present invention. FIGS. 14(*a*) to 14(*d*) schematically show other examples of the antenna apparatus according to the seventh embodiments. This embodiment is characterized in that a dielectric or magnetic material is disposed in the vicinity of the antenna element to improve the directivity of the antenna by using interference caused by the material. FIG. 13(*a*) shows an example where a dielectric or magnetic material 132 is disposed in an antenna 131. FIG. 13(*b*) shows an example where the antenna 131 is wholly covered with the dielectric or magnetic material 132. FIG. 13(*c*) shows an example where the dielectric or magnetic material 132 is divided into portions to surround the antenna 131.

FIGS. 14(*a*) and 14(*b*) show examples where dielectric or magnetic materials 142 of different sizes are disposed in the plane of an antenna 141 so that their sizes continuously vary. With this arrangement a Fresnel lens effect is obtained for the target radio waves, so that the radio waves are effectively received. FIGS. 14(*c*) and 14(*d*) show examples where the dielectric or magnetic materials 142 of different sizes are disposed in a direction vertical to the antenna plane so that their sizes continuously vary. With this arrangement, the abovementioned effect is obtained with respect to the direction vertical to the antenna 141.

Figure 15B:
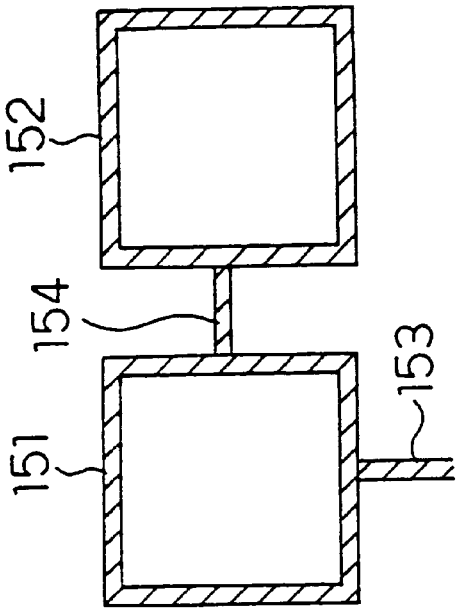
FIGS. 15(*a*) and 15(*b*) schematically show other examples of the antenna apparatus according to the seventh embodiment.
Figure 15A:
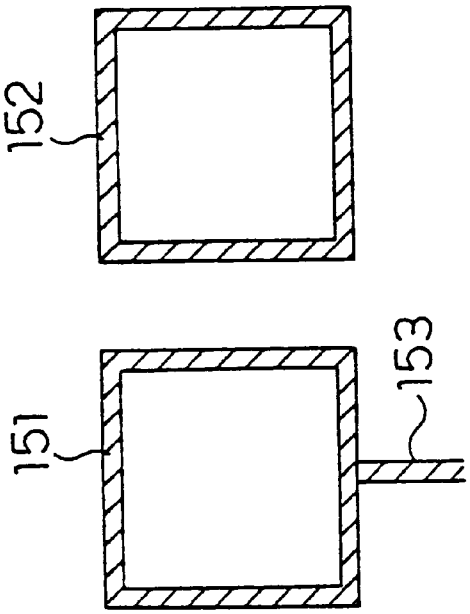

Instead of the dielectric or magnetic material, a conductive material such as a metal may be disposed in the vicinity of the antenna. In this case, as shown in FIG. 15(*a*), a conductive material 152 may be disposed in the vicinity of an antenna 151 having a feeder 153, or as shown in FIG. 15(*b*), the antenna 151 and the conductive material 152 may be connected by a conductive material 154.

Eight Embodiment

Figure 16:
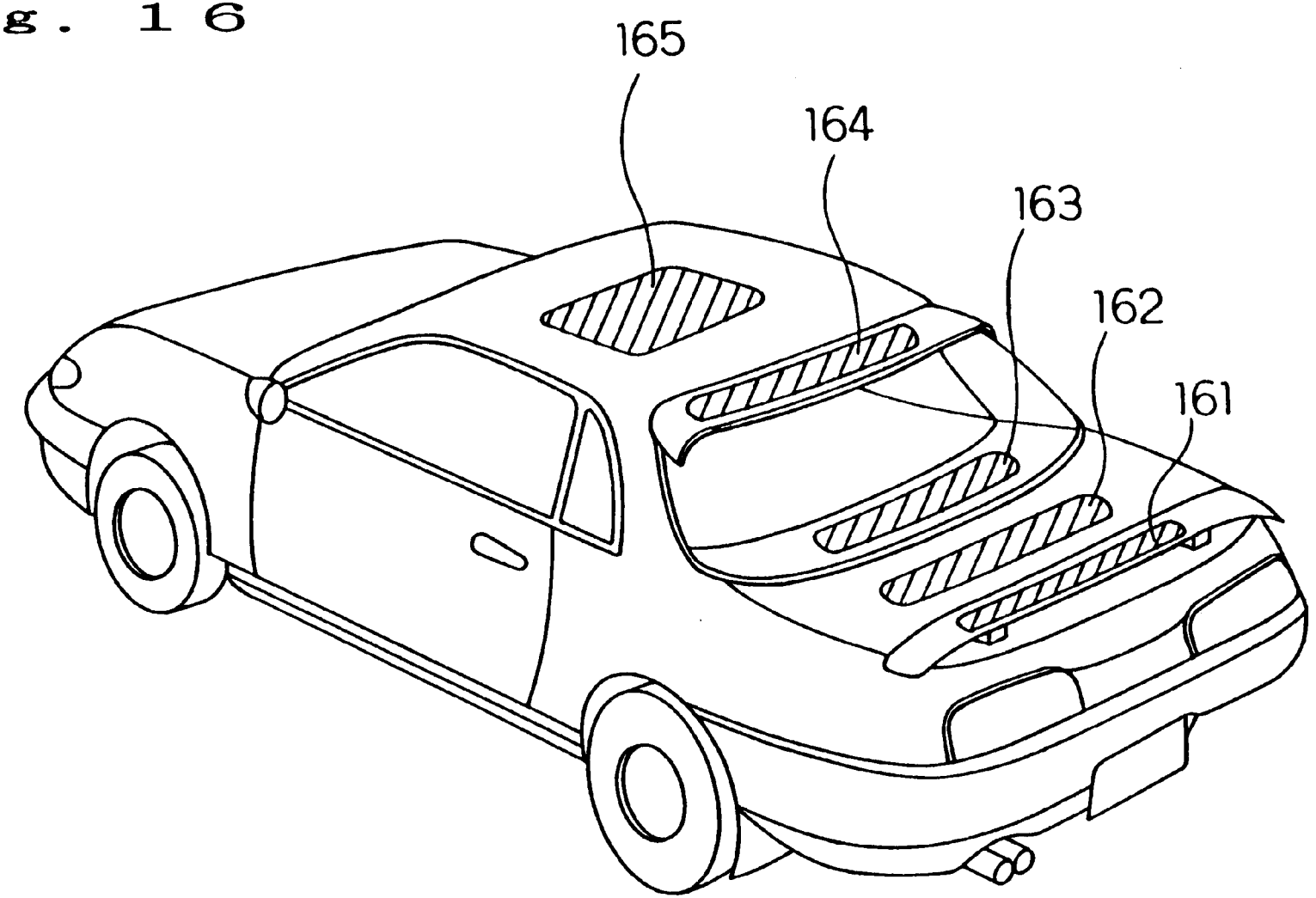
FIG. 16 is an external view for assistance in explaining where to dispose antennas in an eighth embodiment of the present invention.

FIG. 16 is an external view for assistance in explaining where antennas are disposed in an eighth embodiment of the present invention. In this embodiment, where antennas are disposed will be explained with respect to an example where the antennas are mounted on a car. While linear low-profile antennas are mounted in this example, an antenna apparatus may be mounted where a plurality of antennas are disposed intensively or close to each other as described in the above embodiments. As shown in FIG. 16, the antennas are disposed, for example, at a rear spoiler 161, a trunk lid rear panel 162, a rear tray 163, a roof spoiler 164, and a roof 165 such as a sun roof visor.

Figure 17B:
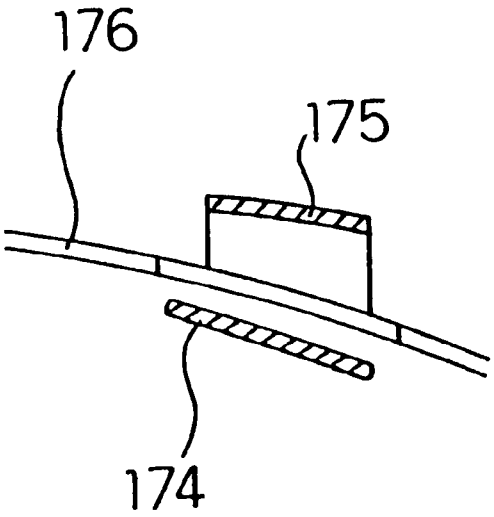
FIGS. 17(*a*) and 17(*b*) cross-sectionally show mounting conditions of antennas in the eighth embodiment.
Figure 17A:
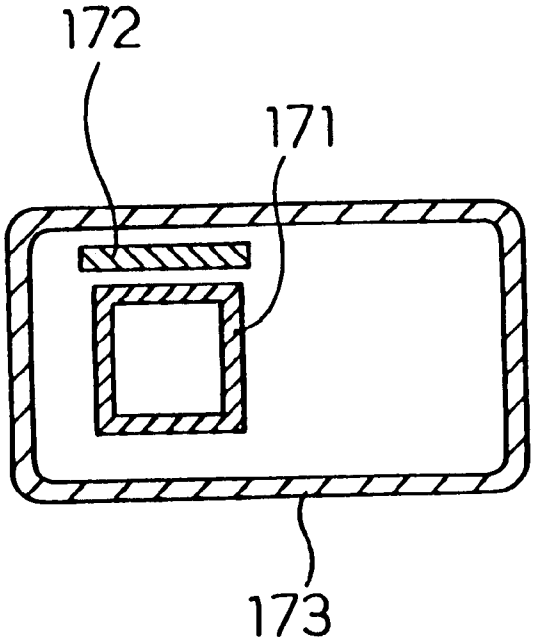

The mounting condition of the antennas is cross-sectionally shown in FIGS. 17(*a*) and 17(*b*). FIG. 17(*a*) shows an example where a pickup antenna 171 is disposed in a car body member 173 with a dielectric material 172 between. FIG. 17(*b*) shows an example where a pickup antenna 174 is disposed inside and a spoiler antenna 175 is disposed outside with a trunk lid 176 between. These examples include the arrangement as described in the seventh embodiment where the dielectric or magnetic material is disposed in the vicinity of the antenna and an arrangement where a conductive car body member is disposed in the vicinity of the antenna. That is, the car body member is used as the material disposed in the vicinity of the antenna in the seventh embodiment.

Figure 18A:
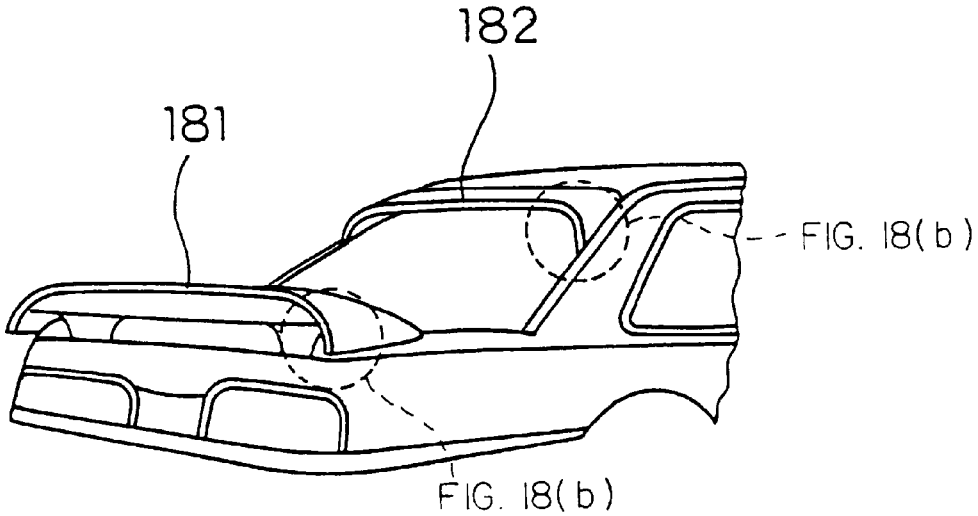
FIG. 18 shows other antenna mounting positions in the eighth embodiment.
Figure 18B:
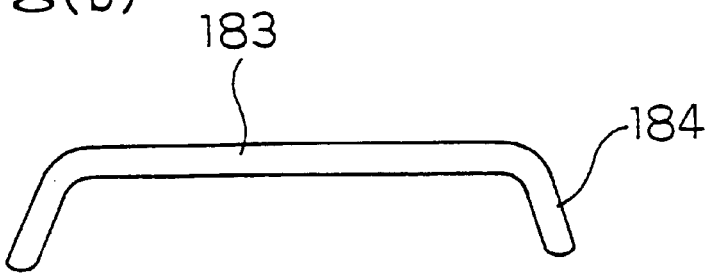

In the case of antennas for vertically polarized waves, as shown in FIG. 18, for example, the antennas are disposed at either end of spoilers 181 and 182 of the car or at an end of the sun visor of the car. That is, in order that vertically polarized waves are readily received, the antennas are set at portions 184 which are as close to the vertical as possible. The antennas may be disposed at other portions of the car as long as they are at an angle to the horizontal. At a plane portion 183 of the spoiler, an antenna for horizontally polarized waves may be disposed.

Ninth Embodiment

Figure 19:
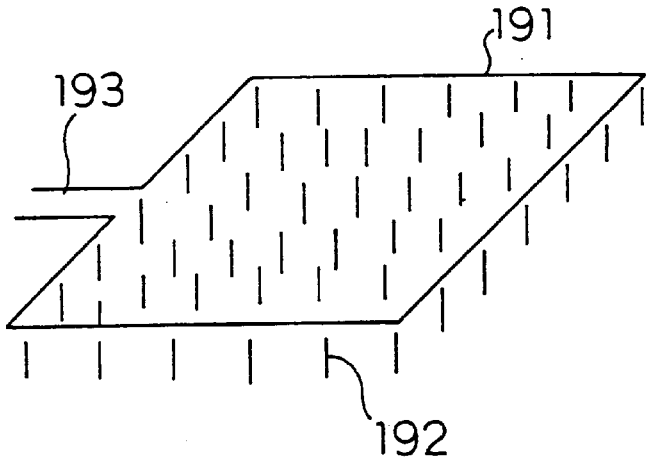
FIG. 19 schematically shows an antenna apparatus according to a ninth embodiment of the present invention.

FIG. 19 schematically shows an antenna apparatus according to a ninth embodiment of the present invention. This embodiment is similar to the seventh embodiment in that a conductive material is disposed in the vicinity of the antenna element, but is designed for different purposes. Although this antenna apparatus is planar as a whole and has a shape of an antenna for horizontally polarized waves, it is designed for vertically polarized waves. That is, in FIG. 19, a multiple number of small monopole antennas 192 (these antennas are not connected to a feeder 193) are disposed under a square loop antenna 191 to be vertical to the antenna plane, and vertically polarized waves are received by the monopole antennas 192 and directed to the loop antenna 191. According to this arrangement, an antenna for vertically polarized waves may be disposed in the horizontal direction like the antenna for horizontally polarized waves.

The horizontally disposed antenna (i.e., the antenna where current is generated) is not limited to the loop antenna but may be an antenna of another type such as a heiro antenna or a square-law antenna. While the number of monopole antennas may be arbitrarily decided, it is desirable that the number be large to some extent.

Tenth Embodiment

Figure 20A:
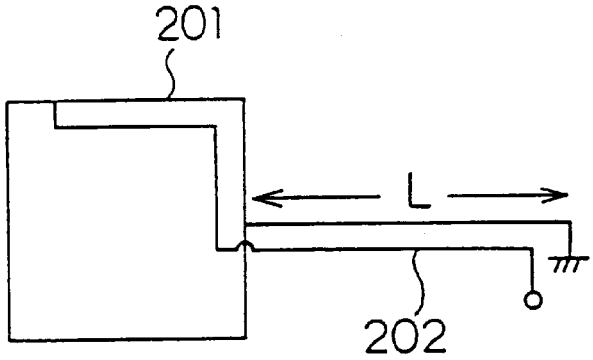
FIGS. 20(*a*) and 20(*b*) diagrammatically show an antenna apparatus according to a tenth embodiment of the present invention.
Figure 20B:
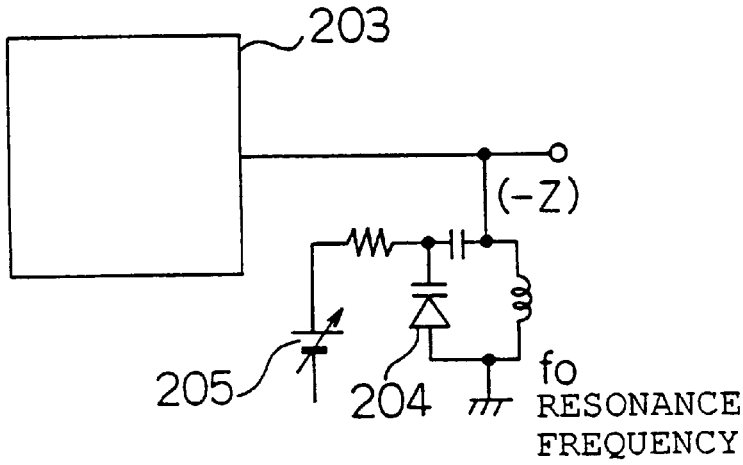

FIG. 20 diagrammatically shows an antenna apparatus according to a tenth embodiment of the present invention. This embodiment is characterized in that the impedance of the feeder is controlled to control the directivity of the antenna. FIG. 20(*a*) shows an example where the length L of a feeder 202 (e.g. coaxial cable) is changed to control the impedance of a square-law antenna 201. This arrangement, however, is not very practical because it is cumbersome to frequently change the length of the feeder. Therefore, as shown in FIG. 20(*b*), a similar function is realized by using a parallel resonance circuit including a varicap 204, a capacitor and a coil. According to this arrangement, by changing a reverse bias voltage 205 of the varicap 204, a resonance frequency f0 of the resonance circuit is changed to change the impedance(−Z), so that the directivity of an antenna 203 is easily controlled. The type of the antenna is not limited to the ones shown in the above-described embodiments.

Eleventh Embodiment

Figure 21:
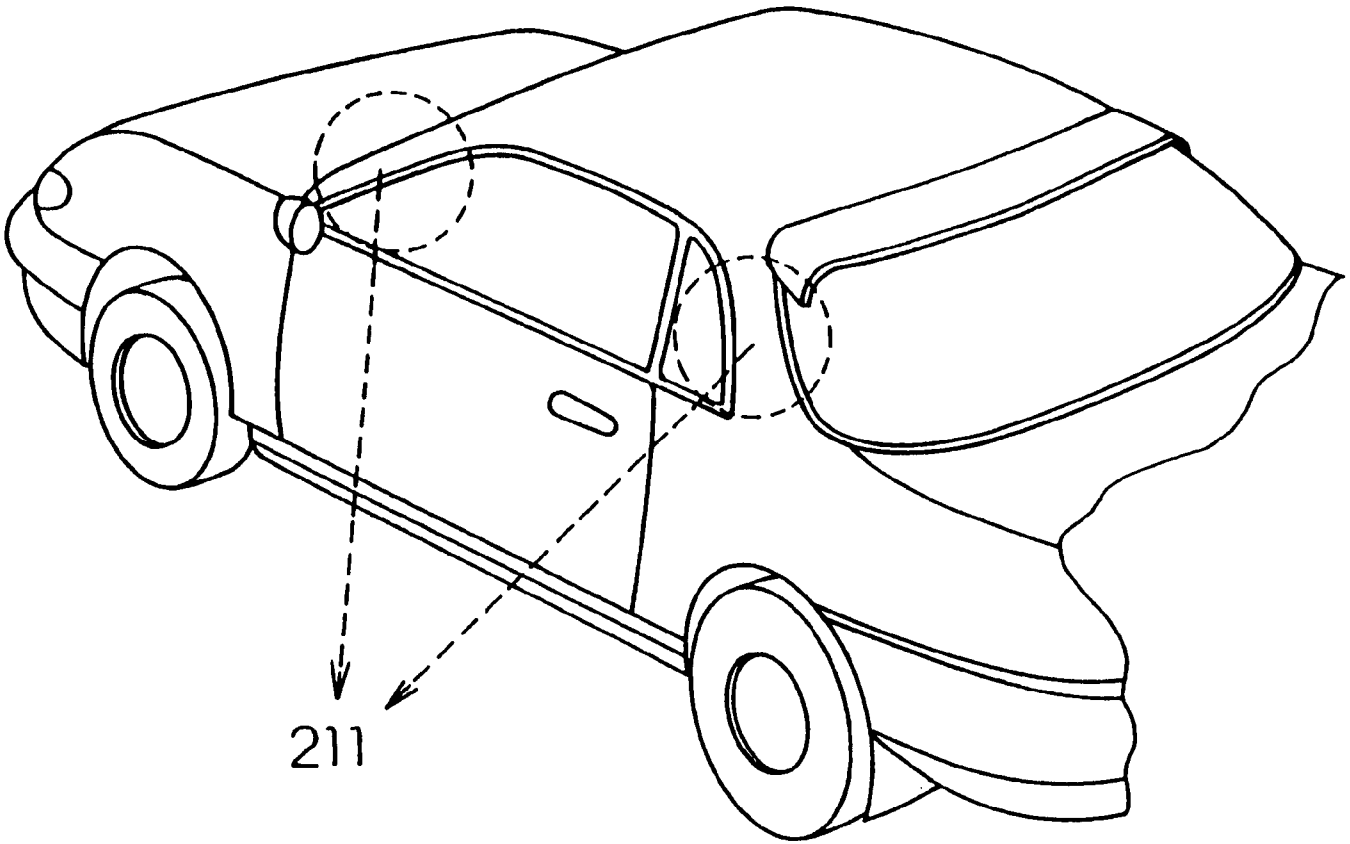
FIG. 21 is an external view for assistance in explaining where to dispose antennas in an eleventh embodiment of the present invention.

In an eleventh embodiment, road-to-car communication antennas such as antennas for LCXs (leakage coaxial cables) or antennas for automatic tollgates used for communications between the road side and the car side, or car-to-car communication antennas used for communications between cars are disposed in the outline of the car body. Specifically, as shown in FIG. 21, the antennas are disposed, for example, at a pillar portion 211 of the car. Since the antenna is set not outside the car body but in the outline thereof, a breakdown from deformation less frequently occurs, so that the reliability of the antenna increases.

Twelfth Embodiment

Figure 22B:
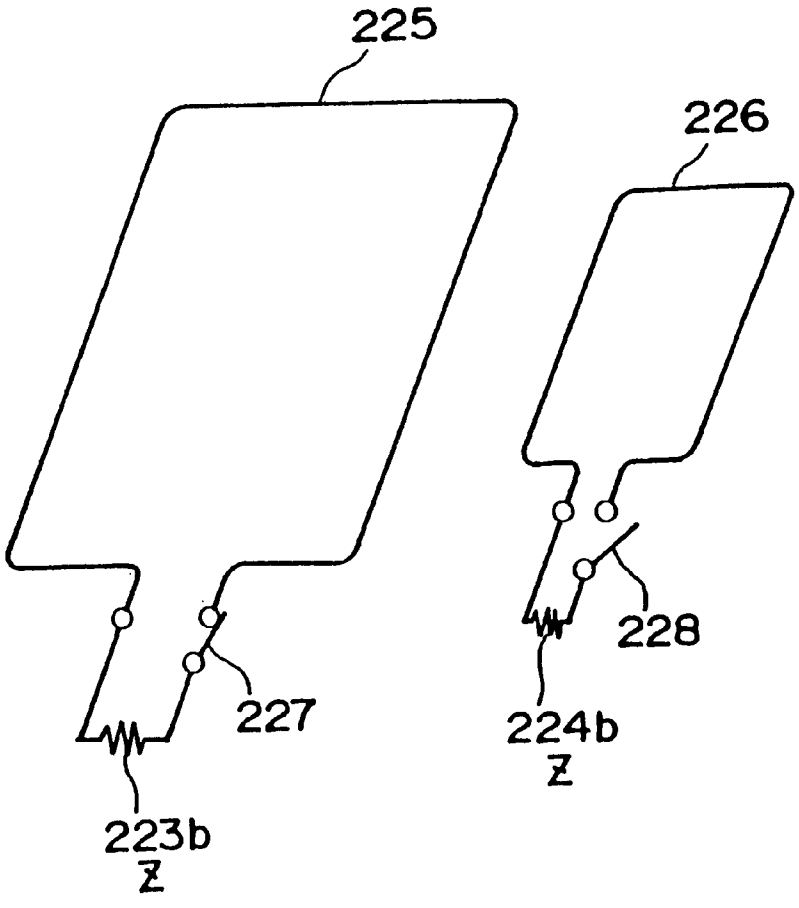
FIGS. 22(*a*) and 22(*b*) diagrammatically show two examples of an antenna apparatus according to a twelfth embodiment of the present invention.
Figure 22A:
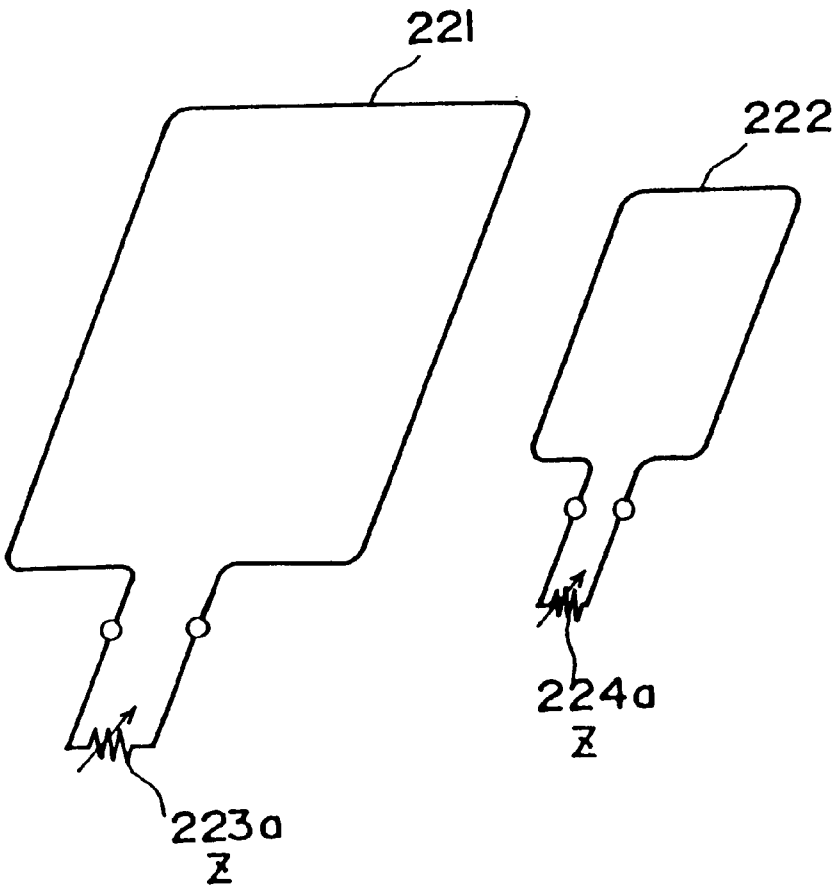

FIGS. 22(*a*) and 22)*b*) diagrammatically show two examples of an antenna apparatus according to a twelfth embodiment of the present invention. In the example shown in FIG. 22(*a*), to the feeders of two loop antennas 221 and 222 disposed close to each other, variable impedances 223*a* and 224*a* are coupled so that the directivities of the antennas formed by the interference therebetween are most desirable. By varying the impedances 223*a* and 224*a,* the directivities of the antennas are controlled so that their gains are the maximum. In the example shown in FIG. 22(*b*), the impedances 223*b* and 224*b* coupled to the feeders of two loop antennas 225 and 226 are fixed and are turned on and off by switches 227 and 228. By turning on the switch 227 of the desired antenna 225 and turning off the switch 228 of the other antenna 226, for example, the directivity gain of the desired antenna is maximized.

While the number of antennas is two in these examples, the number is not limited but may be three or more. Moreover, the type of the antenna is not limited to the loop antenna.

While variable impedance is used in the present embodiment, any means may be used that is capable of varying the impedance of the antenna. The function to vary or turn on and off the impedance of the antenna may be provided to all the antennas or to only a part of the antennas.

Thirteenth Embodiment

Figure 23B:
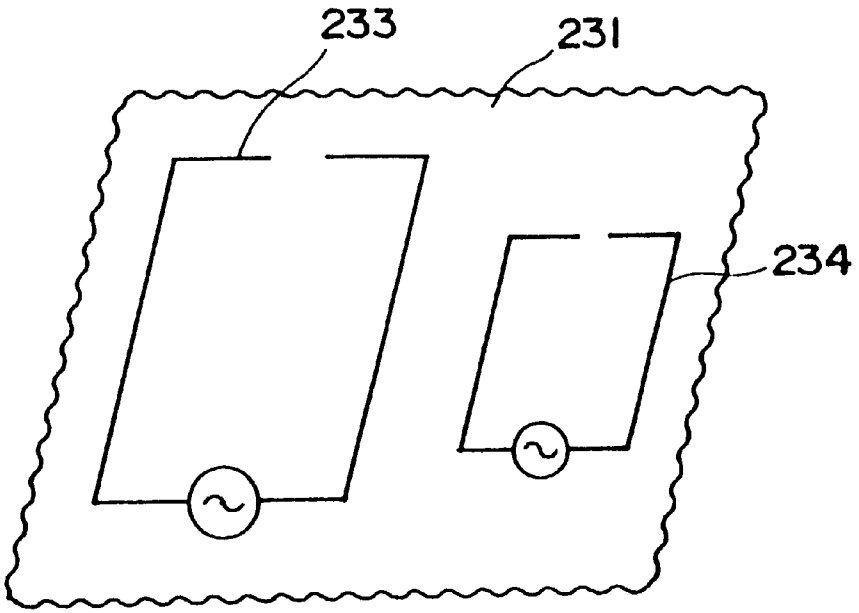
FIGS. 23(*a*) and 23(*b*) diagrammatically show two examples of an antenna apparatus according to a thirteenth embodiment of the present invention.
Figure 23A:
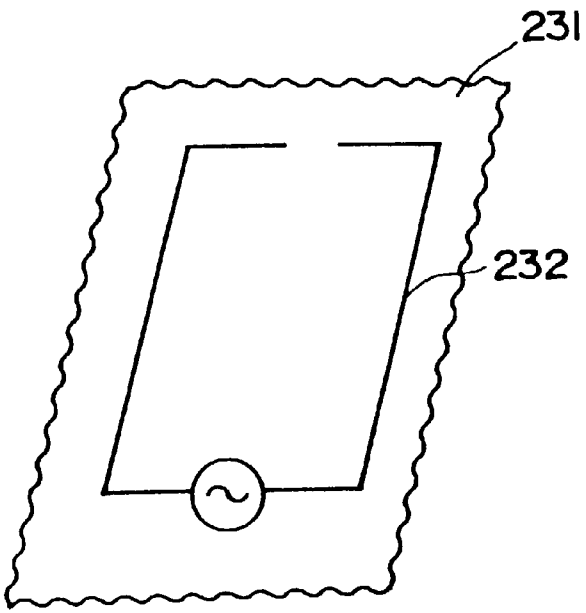

FIG. 23 diagrammatically shows two examples of an antenna apparatus according to a thirteenth embodiment of the present invention. While FIG. 23(*a*) shows an example where one antenna is disposed and FIG. 23(*b*) shows an example where two antennas are disposed, three or more antennas may be disposed and antennas of other types may be disposed in this embodiment. In the example of FIG. 23(*a*), the directivity of an antennas 232 is changed to a desired one by changing the positional relationship between the antenna 232 and a group 231 disposed in the vicinity thereof. In the example of FIG. 23(*b*), the directivities of two antennas 233 and 234 are controlled to be more desirable by changing the positional relationship between the antennas 233 and 234, between the antenna 233 and the ground 231 or between the antenna 234 and the ground 231 to change the interference therebetween.

While the ground comprises a single conductive material in the above-described examples, the car body, for example, may be used as the ground.

Fourteenth Embodiment

Figure 24A:
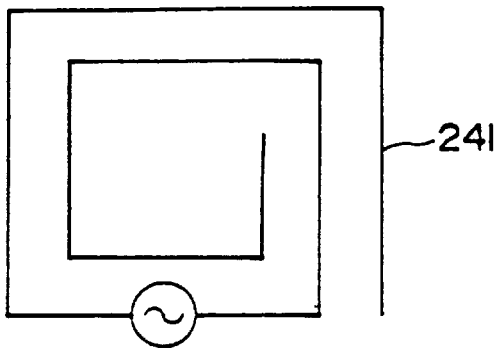
FIGS. 24(*a*)–24(*c*) diagrammatically show three examples of an antenna apparatus according to a fourteenth embodiment of the present invention.
Figure 24B:
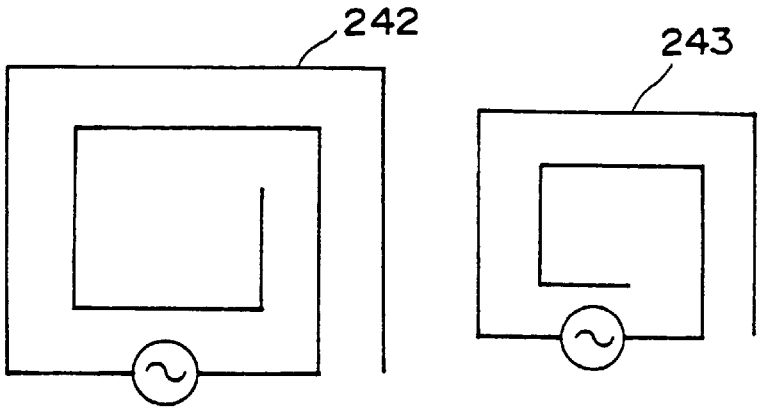
Figure 24C:
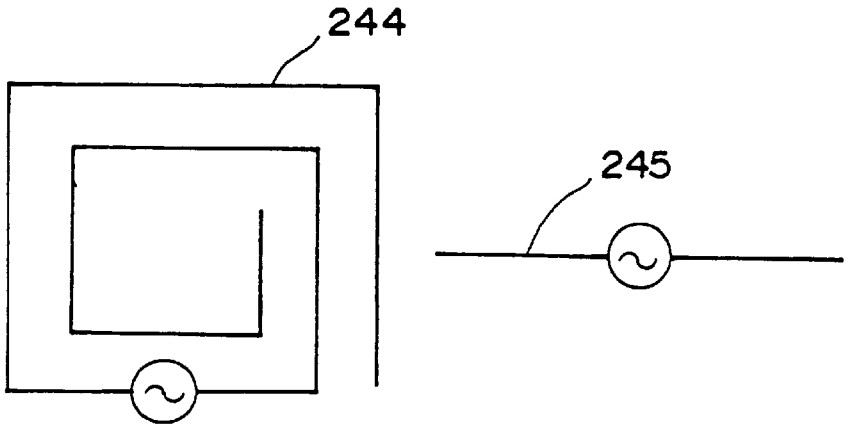

FIGS. 24(*a*) to 24(*c*) diagrammatically show three examples of an antenna apparatus according to a fourteenth embodiment of the present invention. FIG. 24(*a*) shows an example where one antenna according to the present embodiment is disposed. FIG. 24(*b*) shows an example where two antennas of the same type according to the present embodiment are disposed. FIG. 24(*c*) shows an example where an antenna according to the present embodiment and a dipole antenna are disposed. As shown in FIG. 24(*a*), by using a dipole antenna 241 of a spiral form with a predetermined number of turns, the size of the antenna is reduced. As shown in FIG. 24(*b*) by disposing two antennas 242 and 243 according to the present embodiment close to each other, the interference between the antennas improves the directivity gains of the antennas. As shown in FIG. 24(*c*), an antenna 244 of the above-described type and a typical dipole antenna 245 may be disposed close to each other. In this embodiment, the element of a monopole antenna may be wound a predetermined number of times, and the number of antennas disposed close to each other and the types of the antennas are not limited to the ones described above.

Fifteenth Embodiment

Figure 25:
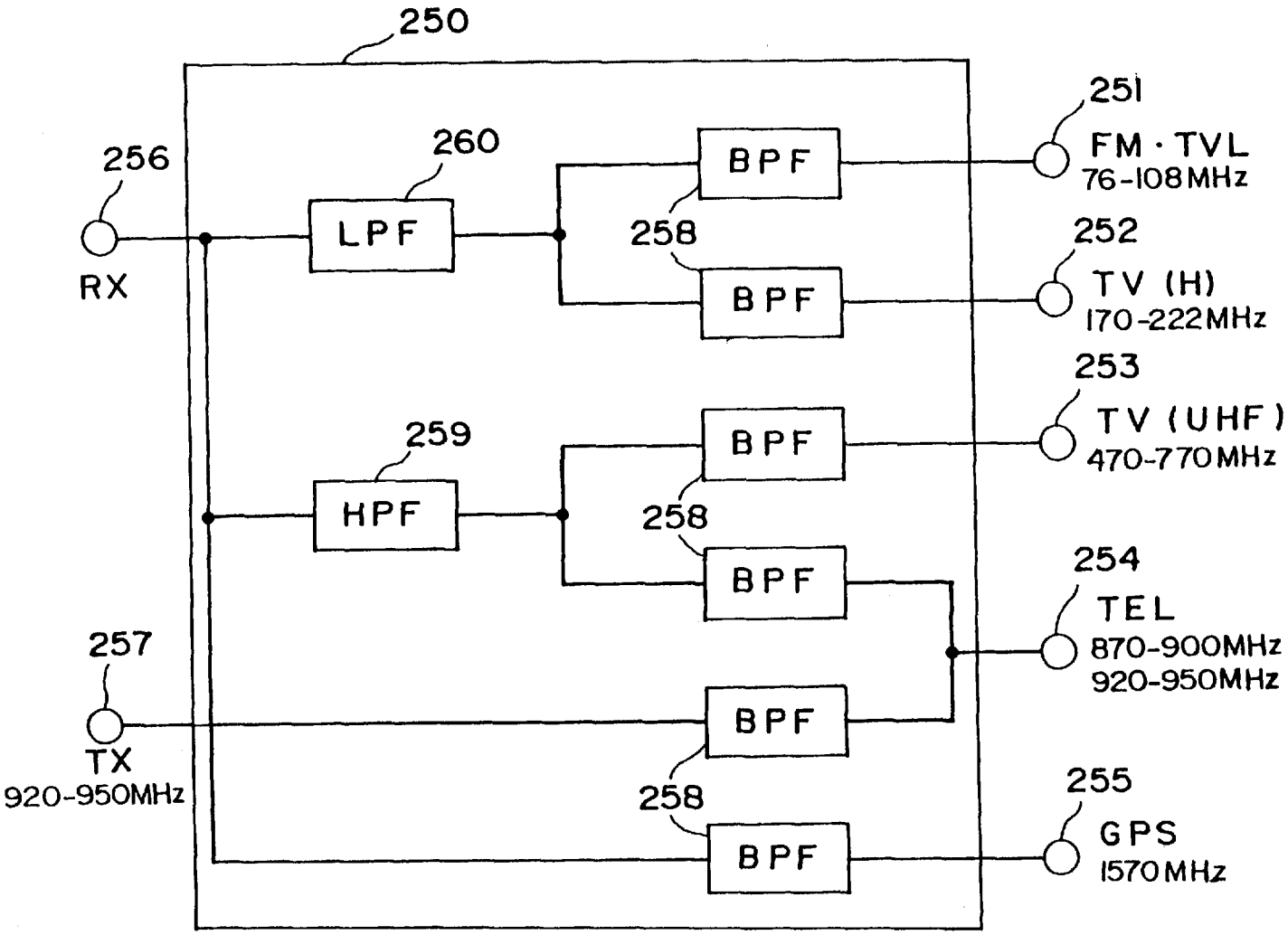
FIG. 25 diagrammatically shows an example of an antenna apparatus according to a fifteenth embodiment of the present invention.
Figure 26:
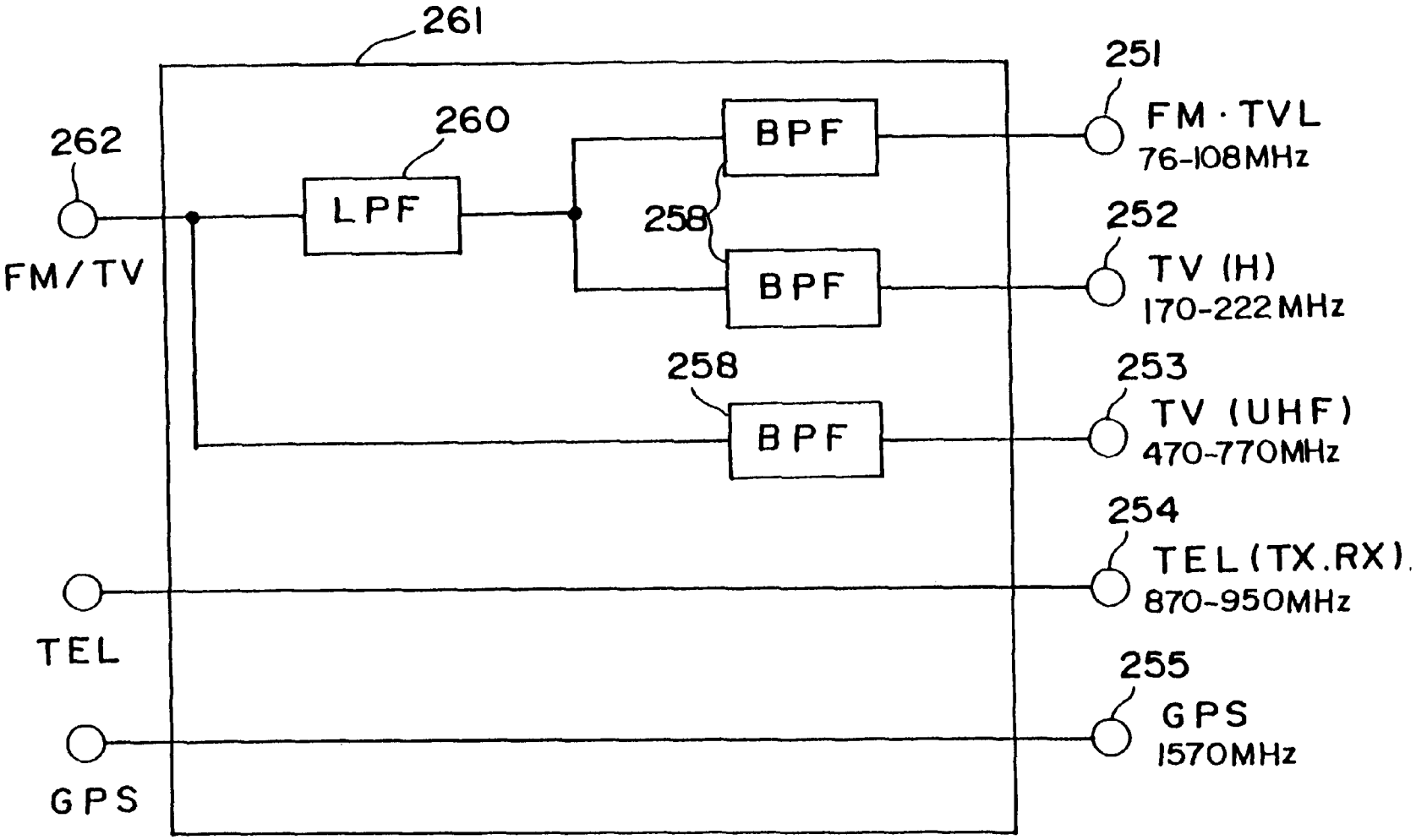
FIG. 26 diagrammatically shows another example of the antenna apparatus according to the fifteenth embodiment.

FIG. 25 diagrammatically shows an example of an antenna apparatus according to a fifteenth embodiment of the present invention. In this embodiment, in an arrangement where a plurality of antennas are disposed, the number of feeders of the plurality of antennas is reduced by using a coupled circuit 250. Specifically, as shown in FIG. 25, feeders 251, 252, 253, 254 and 255 of antennas for FM/TVL, TV(H), TV(UHF), TEL and GPS may be integrated into an all receiving portion 256 and a transmitting portion 257 for TEL by the coupled circuit 250 including band-pass filters (BPF) 258, a high-pass filter (HPF) 259 and a low-pass filter (LPF) 260 each having a desired band. Alternatively, as shown in FIG. 26, the feeders 251, 251 and 253 of the antennas for FM/TVL, TV(H) and TV(UHF) may be integrated into one receiving portion 262 by a coupled circuit 261 including the band-pass filters (BPF) 258 and the low-pass filter (LPF) 260.

A problem with cars, for example, is that an increase in size of the wire harness in the car body increases the complexity of the manufacture process and the weight to increase the size of the car body. With the antenna apparatus of the present embodiment, the number of feeders is reduced, so that the number of steps in the manufacture process and the weight of the cables are reduced.

Sixteenth Embodiment

Figure 27:
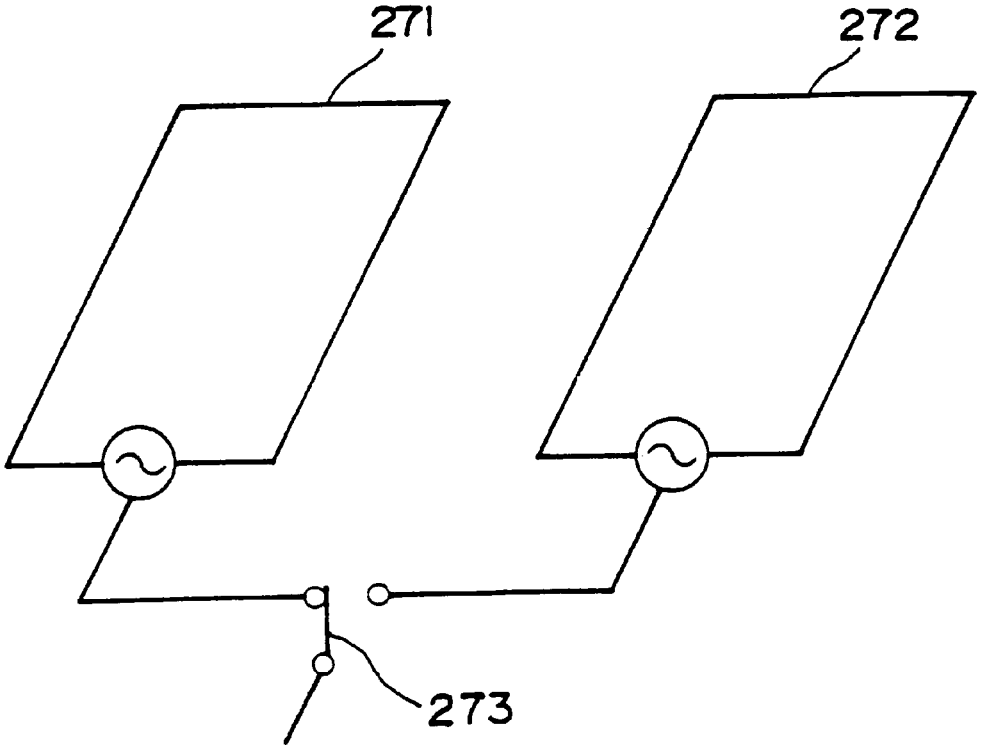
FIG. 27 diagrammatically shows an example of an antenna apparatus according to a sixteenth embodiment of the present invention.

FIG. 27 diagrammatically shows an example of an antenna apparatus according to a sixteenth embodiment of the present invention. In the antenna apparatus of the present embodiment, a plurality of antennas are disposed in a predetermined area in a manner such that the directivities of the antennas are most desirable, and diversity reception is performed where an antenna whose reception condition at the antenna element is most desirable is selected. In FIG. 27, for example, two loop antennas 271 and 272 are disposed in a manner such that their directivities are most desirable and the one of the antennas that provides optimum wave propagation is selected by a diversity change-over switch 273 connected to a feeder. The number of antennas is not limited to two like in the present embodiment but may be three or more, and the type of the antennas is not limited to the loop antenna but another type of antennas or the combination of different types of antennas may be used.

In the above-described embodiment, a plurality of antennas are disposed close to each other in a manner such that the interference therebetween is used. On the contrary, by disposing a plurality of antennas close to each other in a manner such that the interference therebetween is not readily caused, that is, in positions where their directivity gains are low, the interference between the antennas is hardly caused, so that even antennas designed to be suitable for their own target radio waves may be used, without any degradation of the directivities, for the arrangement where a plurality of antennas are disposed in a comparatively small area.

While in the above-described seventh and eighth embodiments, a conductive material or a dielectric material (including glass) or a magnetic material is disposed in the vicinity of the antenna, the antenna may be formed inside or on the surface of a conductive material or a dielectric material or a magnetic material. In this case, greater advantage is obtained by forming the antenna element inside or on the surface of the car body or the window glass.

Seventeenth Embodiment

Figure 28B:
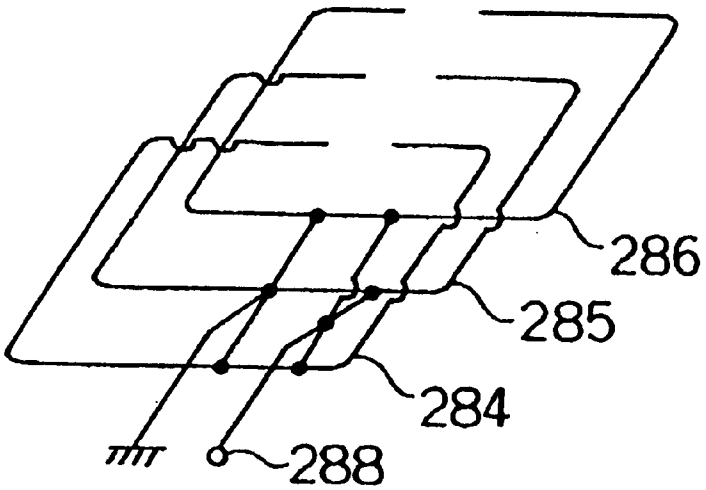
FIG. 28(*a*) and 28(*b*) schematically shows examples of an antenna apparatus according to a seventeenth embodiment of the present invention.
Figure 28A:
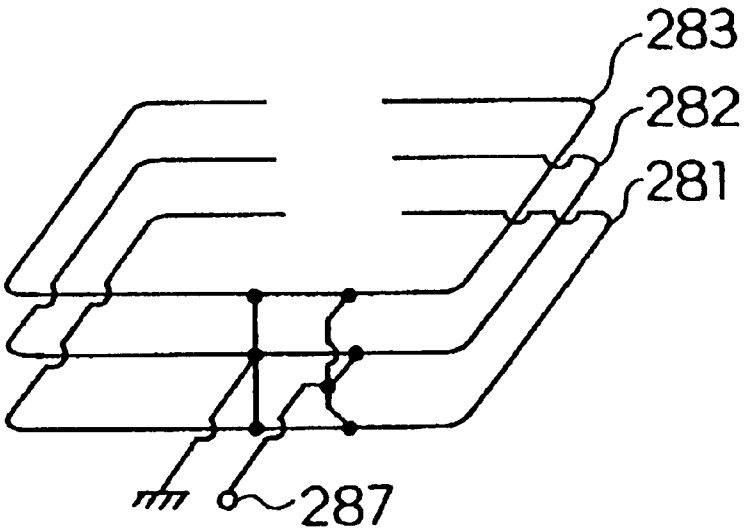

FIG. 28 schematically shows examples of an antenna apparatus according to a seventeenth embodiment of the present invention. Referring to FIG. 28(*a*), in this antenna apparatus, a plurality of antenna devices 281, 282 and 283 are disposed in a layer in a direction vertical to the reference plane (antenna plane), a taps (feeding points) provided in predetermined positions of the antenna devices 281, 281 and 283 are connected to a common feeding terminal 287 for common feeding. The ground sides of feeders of the antenna devices 281, 282 and 283 are also connected to a common point. With this arrangement, one antenna may be formed of a plurality of antenna devices.

Because increasing the length of the antenna devices reduces the tuning frequency and reducing the length increases the tuning frequency, by using the antenna devices 281, 282 and 283 of the same length so that they have the same frequency band, the overall gains of the antenna apparatus is increased, and by using the antenna devices 281, 282 and 283 of different lengths so that they have different frequency bands, the overall frequency band of the antenna apparatus is increased. In the case of the antenna apparatus having a wide frequency band, by using antenna devices having continuously different tuning frequencies, the antenna apparatus is provided with an overall frequency band ranging from the lowest to the highest frequency bands of the antenna devices.

Instead of the above-described arrangement, as shown in FIG. 28(*b*), antenna devices 284, 285 and 286 may be disposed to obliquely layer each other so that their projection surfaces overlap to the reference surface. In this arrangement, the connection at the feeders is the same as that of FIG. 28(*a*).

In the above-described antenna apparatuses, the feeding impedance is controlled by adjusting the positions of taps of the antenna devices.

Figure 29:
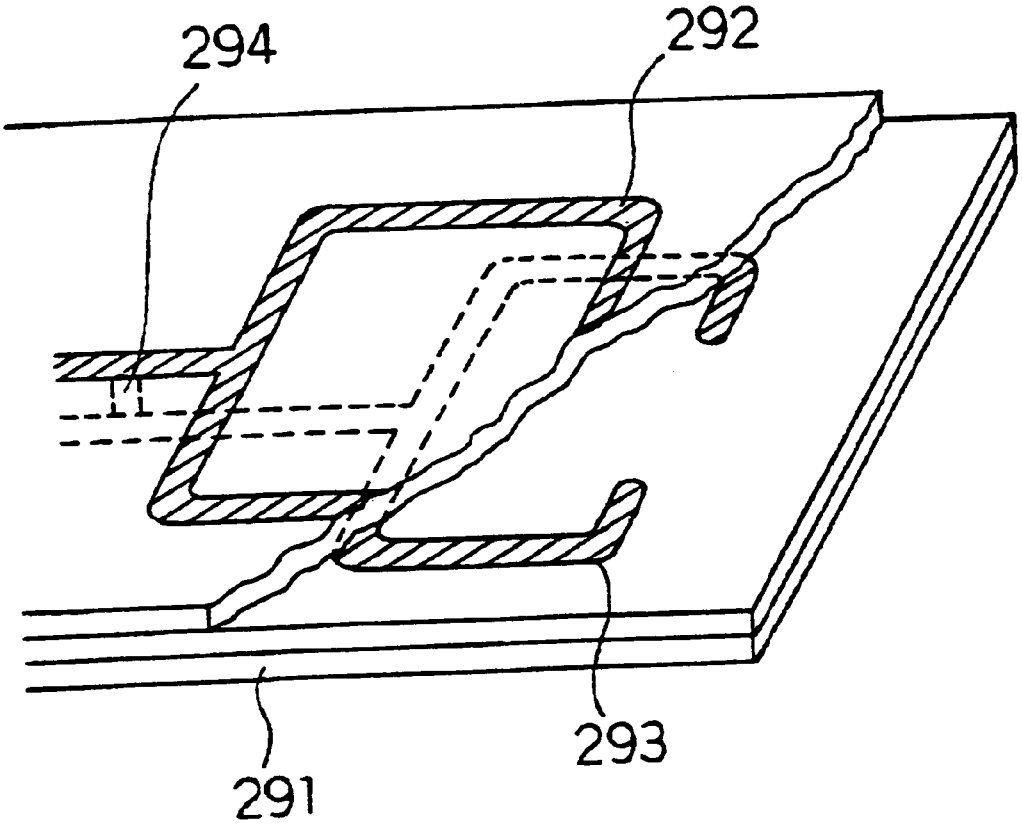
FIG. 29 is a partially cutaway view showing an example where the antenna apparatus of the seventeenth embodiment is formed by use of a multilayer printed circuit board.

FIG. 29, which shows an application of the present embodiment, is a partially cutaway view of an arrangement where two antenna devices 292 and 293 are formed by using printed writing in different layers of a multilayer printed circuit board 291. The connection between the antenna devices 292 and 293 in a predetermined position is enabled by passing a conductive material through a through hole 294. By thus forming antenna devices on a multilayer printed circuit board by use of printed wiring, a high-gain and wide-frequency-band antenna apparatus is easily realized.

While the number of antenna devices is two or three in the present embodiment, the number may be four or more. In that case, the antenna devices may all have the same tuning frequencies, or some of them may have different tuning frequencies, or they may all have different tuning frequencies.

Eighteenth Embodiment

Figure 30A:
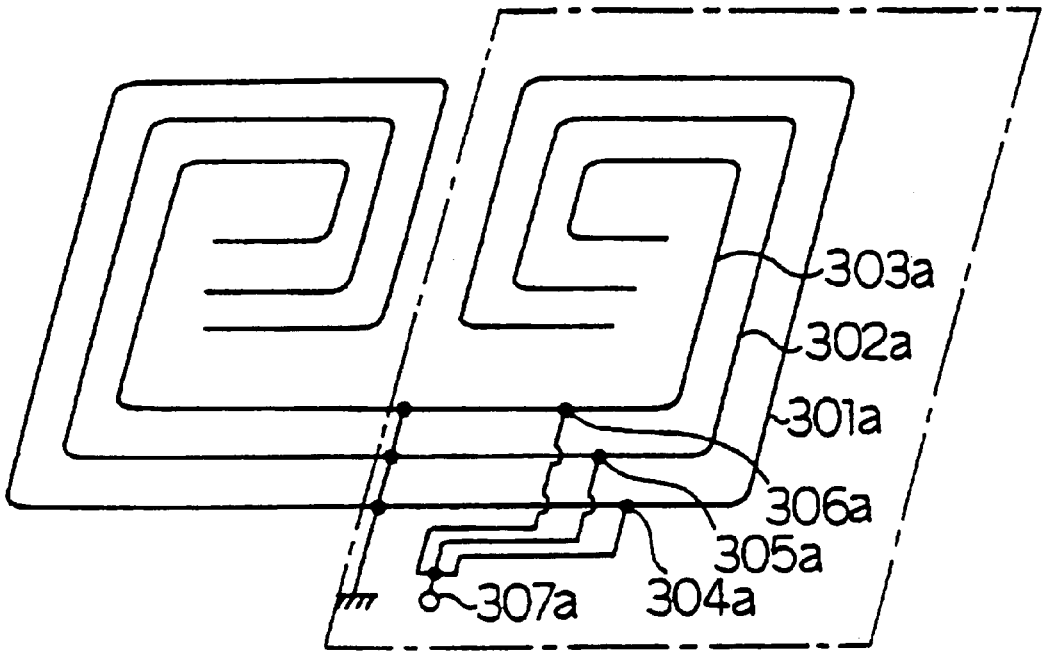
FIGS. 30(*a*) and 30(*b*) schematically show examples of an antenna apparatus according to an eighteenth embodiment of the present invention.
Figure 30B:
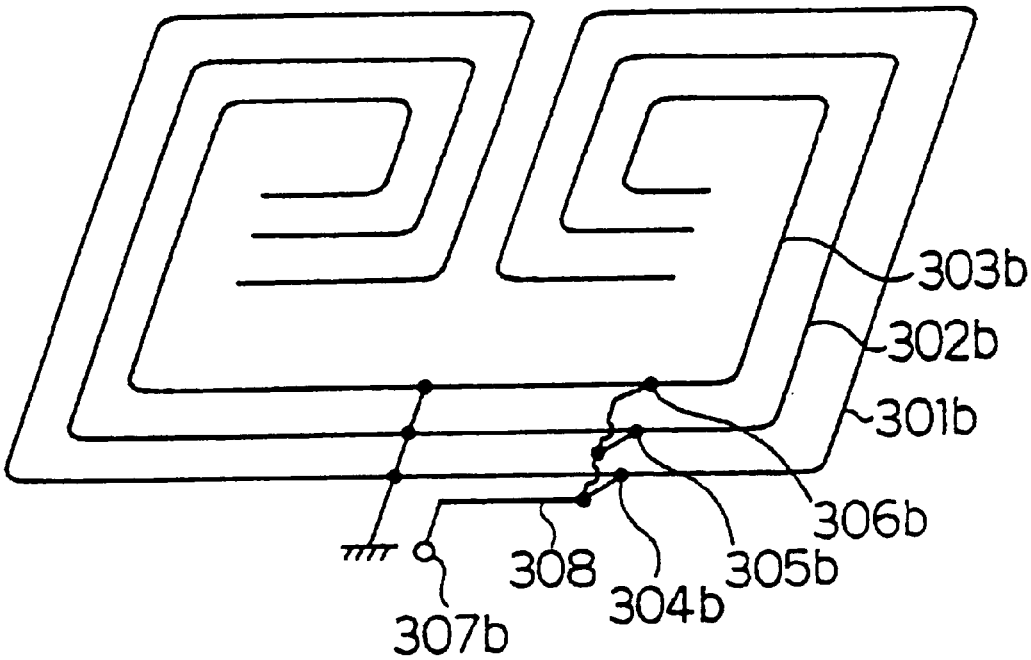

FIG. 30(*a*) and 30(*b*) schematically show examples of an antenna apparatus according to an eighteenth embodiment of the present invention. In this embodiment, a plurality of antenna devices are connected to a common feeding point. Referring to FIG. 30(*a*), taps 304*a*, 305*a* and 306*a* are formed in predetermined positions of antenna devices 301*a*, 302*a* and 303*a*, respectively, and the taps 304*a*, 305*a* and 306*a* are connected to a common feeding terminal 307*a*. The feeding impedance is controlled by adjusting the positions of the taps. While the taps of the antenna devices are formed in the same direction in this arrangement, they may be formed in arbitrary directions.

FIG. 30(*b*) shows a modification of the above-described antenna apparatus of FIG. 30(*a*). In this modification, taps 304*b*, 305*b* and 306*b* formed in predetermined positions of antenna devices 301*b*, 302*b* and 303*b* are connected via a common electrode 308 to a feeding terminal 307*b*. With this arrangement, not only the structure of the antenna apparatus is simplified but also a more space-saving antenna apparatus is realized by disposing the electrode 308 in parallel with the outermost antenna device 301*b*, for instance. In addition, since the electrode 308 and the portions of the antenna devices 301*b,* 302*b* and 303*b* which are in parallel with the electrode 308 are formed in one step, the manufacture process is facilitated.

Figure 31A:
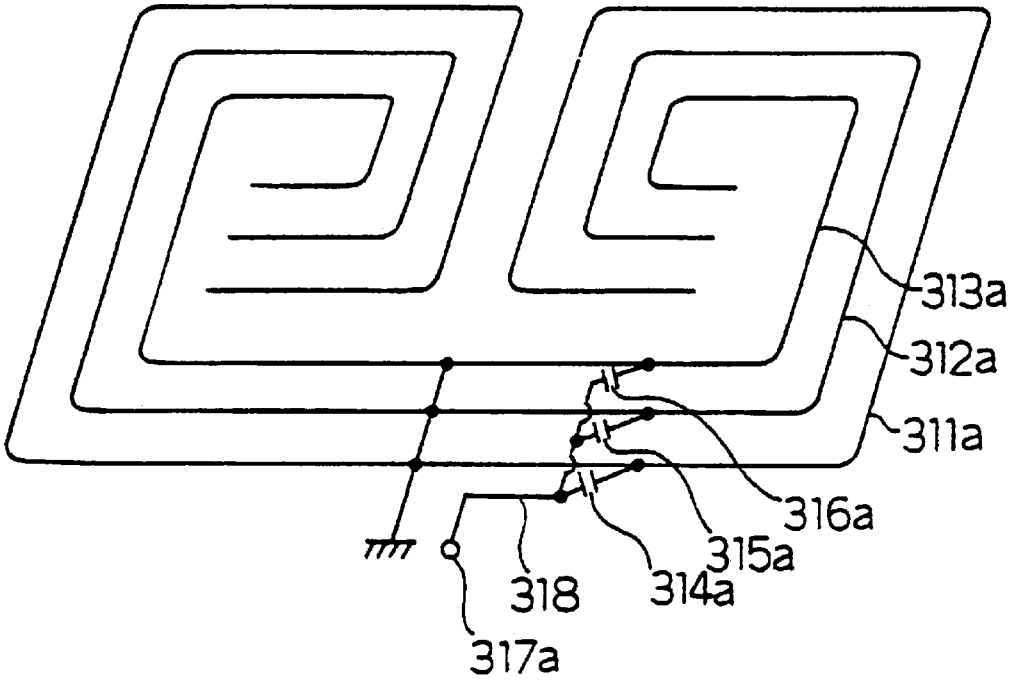
FIGS. 31(*a*) and 31(*b*) schematically show other examples of the antenna apparatus according to the eighteenth embodiment.
Figure 31B:
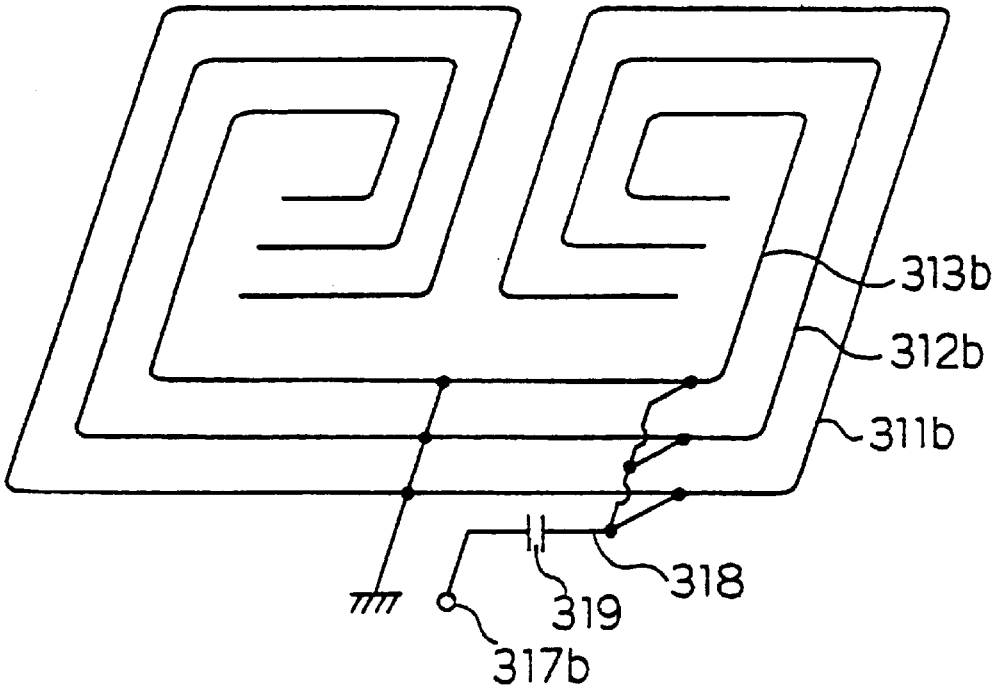

FIG. 31(*a*) and 31(*b*) show examples where reactance devices are provided at the feeders of the antenna apparatus of the present embodiment. FIG. 31(*a*) shows an example where taps of antenna devices 311*a,* 312*a* and 313*a* are connected via reactance devices (in this case, capacitors) 314*a,* 315*a* and 316*a* to a common electrode 318 which is connected to a feeding terminal 317*a*. FIG. 31(*b*) shows an example where taps of antenna devices 311*b,* 312*b* and 313*b* are connected to a common electrode 318 which is connected via a reactance device (in this case, a capacitor) 319 to a feeding terminal 317*b*. Further, as shown in FIG. 31, a reactance device 328 may be connected between a feeding terminal 327 and the ground terminal in the arrangement of FIG. 31(*a*).

Thus, with the use of an appropriate reactance device at the feeder, desired feeding impedance, frequency band and maximum radiation efficiency are obtained by adjusting the reactance device as well as by adjusting the positions of taps of the antenna devices. As the reactance device, a capacitor may be used like in the above-described examples or an inductor may be used. Further, a variable reactance device may be used so that the impedance is variable.

Figure 32:
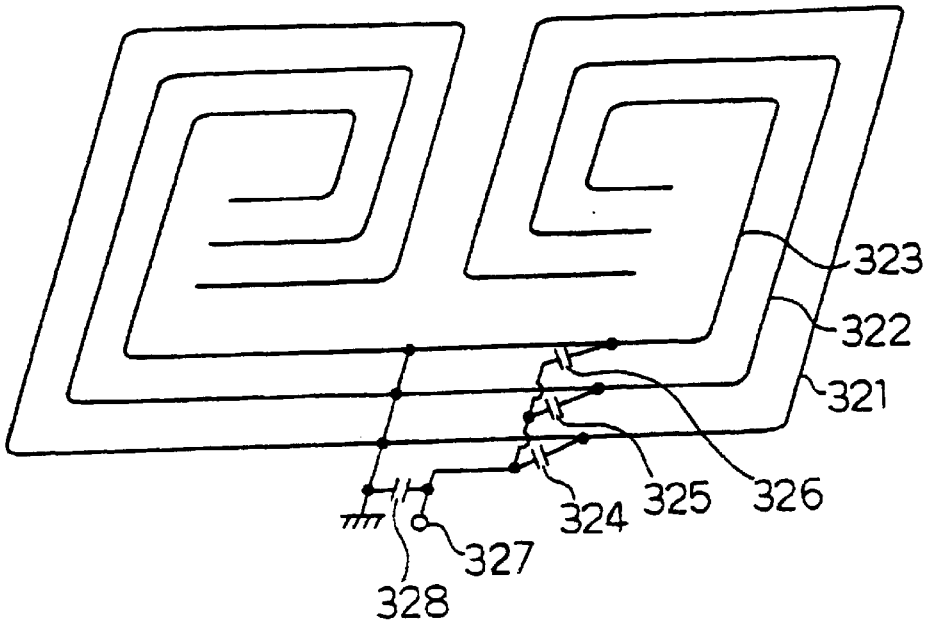
FIG. 32 schematically shows another example of the antenna apparatus according to the eighteenth embodiment.

While antenna devices of a dipole type are used in the present embodiment, the type of the antenna devices is not limited thereto. Antenna devices of a monopole type, for example, may be used, which comprise only the portion enclosed by the dash and dotted line in FIG. 30(*a*). The same applies to the antenna apparatuses of FIG. 30(*b*) and FIGS. 31 and 32 and to a subsequently-described antenna apparatus of FIG. 33.

While three antenna devices are provided in the present embodiment, two antenna devices or four or more antenna devices may be provided. In that case, the antenna devices may all have the same tuning frequencies, or some of them have different tuning frequencies, or they may all have different turning frequencies. That is, the length of each antenna device is adjusted so that a desired tuning frequency is obtained.

Nineteenth Embodiment

Figure 33:
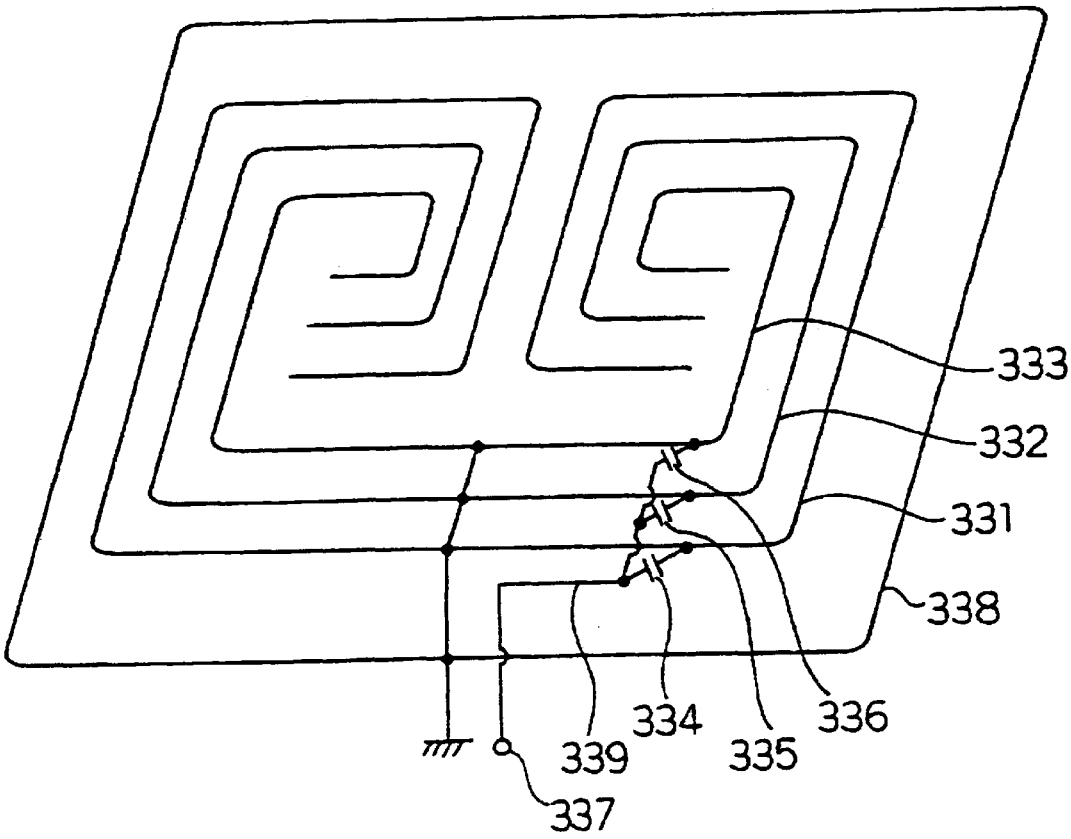
FIG. 33 schematically shows an example of an antenna apparatus according to a nineteenth embodiment of the present invention.

FIG. 33 schematically shows an example of an antenna apparatus according to a nineteenth embodiment of the present invention. In this embodiment, a conductive ground plate 338 is disposed to face the antenna planes of antenna devices 331, 332 and 333 whose feeders have their ground terminals connected to the conductive ground plate 338. Other parts are arranged similarly to FIG. 31(*a*). This is, taps formed in predetermined positions of the antenna devices 331, 332 and 333 are connected to reactance devices 334, 335 and 336 which are connected via a common electrode 339 to a feeding terminal 337. With this arrangement, when antenna devices of the same length and configuration are used, an antenna apparatus is realized which was high gain and wide band in a higher frequency band as compared to the arrangement where no conductive ground plate is provided.

While three antenna devices are provided in the present embodiment, two antenna devices or four or more antenna devices may be provided. In that case, the antenna devices may all have the same tuning frequencies, or some of them have different tuning frequencies, or they may all have different tuning frequencies. That is, the length of each antenna device is adjusted so that a desired tuning frequency is obtained.

While the arrangement of FIG. 31(*a*) is used as the basic arrangement of the present embodiment, other arrangements such as the ones shown in FIG. 31(*b*) and FIGS. 30(*a*) and 30(*b*) may be used as the basic arrangement to which the conductive ground plate connected to the ground terminal of the feeder is added.

As is apparent from the above description, according to the present invention, since the size, configuration and mounting condition of a plurality of antennas disposed in a predetermined area are set so that the directivities of the antennas formed by the interference therebetween are more desirable, a plurality of antennas may be disposed intensively or close to each other in a small area, so that the size of the antenna apparatus is reduced.

Moreover, by disposing two antennas in a manner such that their antenna outputs have opposite phases for a radio wave coming from a predetermined direction and synthesizing the two antenna outputs, noises coming from the predetermined direction are prevented.

What is claimed is:

1. An antenna apparatus, comprising a plurality of antenna devices, the antenna devices:

each being disposed so as to have a same directivity, each having a feeding point connected to a common feeding terminal, each having a ground point connected to a common ground, and each being positioned such that a distance between the antennas is less than or equal to $\lambda/4$ of a wavelength to be carried by the antenna devices wherein each feeding point directly is connected to an associated ground point without a reactive device therebetween, and a last ground point directly is connected to the common ground without a reactive device therebetween.

2. The antenna apparatus according to claim 1, wherein a conductive ground plane is disposed to face antenna planes of said plurality of antenna devices, and wherein the ground point of each of the antenna devices is connected to said conductive ground plane.

3. The antenna apparatus according to claim 1, wherein a reactance device is disposed between said feeding points of the plurality of antenna devices and said common feeding terminal.

4. The antenna apparatus according to claim 3, wherein said reactance device is a variable reactance device.

5. The antenna apparatus according to claim 1, wherein a reactance device is disposed in parallel between the common feeding terminal and the common ground.

* * * * *